US012221669B2

(12) United States Patent
Hirata et al.

(10) Patent No.: US 12,221,669 B2
(45) Date of Patent: Feb. 11, 2025

(54) HOT-ROLLED STEEL SHEET, HOT-DIP COATED STEEL SHEET, AND METHOD FOR PRODUCING HOT-ROLLED STEEL SHEET

(71) Applicant: NIPPON STEEL CORPORATION, Tokyo (JP)

(72) Inventors: Kentarou Hirata, Tokyo (JP); Masaharu Oka, Tokyo (JP); Masahito Sakaki, Tokyo (JP); Mamoru Saito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 18/709,045

(22) PCT Filed: Sep. 22, 2022

(86) PCT No.: PCT/JP2022/035288

§ 371 (c)(1),
(2) Date: May 10, 2024

(87) PCT Pub. No.: WO2023/084926

PCT Pub. Date: May 19, 2023

(65) Prior Publication Data

US 2024/0425945 A1 Dec. 26, 2024

(30) Foreign Application Priority Data

Nov. 12, 2021 (JP) ..... 2021-185120

(51) Int. Cl.
*C21D 9/46* (2006.01)
*C21D 8/02* (2006.01)
(Continued)

(52) U.S. Cl.
CPC ..... *C21D 9/46* (2013.01); *C21D 8/0226* (2013.01); *C21D 8/0242* (2013.01);
(Continued)

(58) Field of Classification Search
None
See application file for complete search history.

(56) References Cited

U.S. PATENT DOCUMENTS

2016/0017465 A1 1/2016 Toda et al.
2023/0287530 A1 9/2023 Kobayashi et al.

FOREIGN PATENT DOCUMENTS

CN 105102658 A 11/2015
JP 2005-248240 A 9/2005
(Continued)

*Primary Examiner* — Anthony M Liang
(74) *Attorney, Agent, or Firm* — Renner, Otto, Boisselle & Sklar, LLP

(57) ABSTRACT

A hot-rolled steel sheet which has excellent rigidity along with high strength, excellent workability, and excellent LME resistance is provided. A hot-rolled steel sheet of the present embodiment consists of, in mass %, C: 0.040 to 0.120%, Si: 0.01 to 0.60%, Mn: 0.50 to 1.50%, P: 0.025% or less, S: 0.010% or less, Al: 0.010 to 0.070%, N: 0.0070% or less, Ti: 0.055 to 0.200%, and B: 0.0010 to 0.0050%, with the balance being Fe and impurities. In the microstructure of the hot-rolled steel sheet, an area fraction of bainitic ferrite is 85% or more and the dislocation density is $8.0\times10^{13}$ to $100.0\times10^{13}/m^2$. The average equivalent circular diameter of Ti carbides in the hot-rolled steel sheet is 10 nm or less, and the average equivalent circular diameter of grains of the bainitic ferrite is 15 μm or less.

4 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C23C 2/02*** | (2006.01) |
| ***C23C 2/06*** | (2006.01) |
| ***C23C 2/40*** | (2006.01) |

(52) U.S. Cl.

CPC ..... *C21D 8/0273* (2013.01); *C22C 38/002* (2013.01); *C22C 38/02* (2013.01); *C22C 38/04* (2013.01); *C22C 38/06* (2013.01); *C22C 38/14* (2013.01); *C23C 2/0224* (2022.08); *C23C 2/06* (2013.01); *C23C 2/40* (2013.01); *C21D 2211/002* (2013.01); *C21D 2211/004* (2013.01); *C21D 2211/005* (2013.01)

(56) References Cited

FOREIGN PATENT DOCUMENTS

| | | | | |
|---|---|---|---|---|
| JP | 2013133534 | A | * | 7/2013 |
| JP | 2017-179539 | A | | 10/2017 |
| JP | 2018-003062 | A | | 1/2018 |
| JP | 2018-119207 | A | | 8/2018 |
| JP | 2018-145500 | A | | 9/2018 |
| WO | 2008-007753 | A1 | | 1/2008 |
| WO | 2015-093596 | A1 | | 6/2015 |
| WO | 2021/210644 | A1 | | 10/2021 |

* cited by examiner

HOT-ROLLED STEEL SHEET, HOT-DIP COATED STEEL SHEET, AND METHOD FOR PRODUCING HOT-ROLLED STEEL SHEET

TECHNICAL FIELD

The present disclosure relates to a hot-rolled steel sheet, a hot-dip coated steel sheet obtained by forming a hot dip galvanized layer on the surface of the hot-rolled steel sheet, and a method for producing a hot-rolled steel sheet.

BACKGROUND ART

Hot-rolled steel sheets are widely utilized for automobiles, electrical machinery, building materials, and construction equipment and the like. Hot-rolled steel sheets which are used for these applications are required to have high strength. On the other hand, hot-rolled steel sheets are processed into various shapes in order to be used in the aforementioned applications. Therefore, hot-rolled steel sheets are required to have not only high strength, but also to have excellent workability.

Techniques for increasing the strength and workability of hot-rolled steel sheets are proposed in Japanese Patent Application Publication No. 2018-003062 (Patent Literature 1) and Japanese Patent Application Publication No. 2017-179539 (Patent Literature 2).

Patent Literature 1 discloses a hot-rolled steel sheet that has a chemical composition consisting of, in mass %, C: 0.04 to 0.18%, Si: 0.2 to 2.0%, Mn: 1.0 to 3.0%, P: 0.03% or less, S: 0.005% or less, Al: 0.01 to 0.100%, N: 0.010% or less, Ti: 0.03 to 0.15%, Cr: 0.10 to 0.50%, and B: 0.0005 to 0.0050%, with the balance being Fe and unavoidable impurities. In the microstructure of this hot-rolled steel sheet, an area fraction of a bainitic phase is 85% or more, an area fraction of an austenite phase is 1 to 8%, and an area fraction of a martensite phase is 3% or less. In addition, in the austenite phase, grains with a diameter of 0.8 μm or less account for 70% or more of the entire austenite phase.

In Patent Literature 1, the microstructure of the hot-rolled steel sheet is principally composed of a bainitic phase, and a fine austenite phase is dispersed in the bainitic phase. Patent Literature 1 describes that, by this means, high strength and excellent workability are obtained.

Patent Literature 2 discloses a hot-rolled steel sheet having a chemical composition that consists of, in mass %, C: 0.03 to 0.08%, Si: 0.01 to 1.50%, Mn: 0.1 to 1.5%, Ti: 0.05 to 0.15%, B: 0.0002 to 0.0030%, P: 0.1% or less, S: 0.005% or less, Al: 0.5% or less, N: 0.009% or less, Nb, Mo and V: 0 to 0.02% in total, and Ca and REM: 0 to 0.01% in total, with the balance being Fe and impurities. In addition, a mass ratio (Ti/C) of the content of Ti to the content of C in the chemical composition is 0.625 to 3.000. In this hot-rolled steel sheet, furthermore, the dislocation density is $1\times10^{14}$ to $1\times10^{16}$ $m^{-2}$. Further, the average diameter of TiC precipitates within the grains is 2.0 nm or less, and the average number density of TiC precipitates within the grains is $1\times10^{17}$ to $5\times10^{19}$ pieces/$cm^3$. In addition, within the grains, the content of Ti present as TiC precipitates which precipitated in the parent phase which is not on dislocations is 30% or more by mass of the total content of Ti in the steel sheet.

In the hot-rolled steel sheet of Patent Literature 2, a high tensile strength of 780 MPa or more is obtained by increasing the dislocation density and causing TiC precipitates to be formed in the parent phase which is not on dislocations. In addition, Patent Literature 2 describes that by lowering the content of alloying elements, the workability of the hot-rolled steel sheet can be increased.

With respect to hot-rolled steel sheets, furthermore, in some cases a hot dip galvanized layer is formed on the surface of the hot-rolled steel sheets to increase corrosion resistance. Hereinafter, a hot-rolled steel sheet on which a hot dip galvanized layer has been formed is also referred to as a "hot-dip coated steel sheet".

A hot-rolled steel sheet on which a hot dip galvanized layer has been formed (hot-dip coated steel sheet) may in some cases be welded to another steel member. During welding, a part of the hot dip galvanized layer melts. Further, in some cases the hot-dip metal (zinc) may penetrate into the grain boundaries of the hot-rolled steel sheet, leading to the occurrence of cracks. Such cracks are referred to as liquid metal embrittlement (LME).

Hot-rolled steel sheets are required to have not only high strength and excellent workability, but are also required to have a characteristic such that the occurrence of LME can be suppressed in a case where a hot dip galvanized layer is formed on the surface of the hot-rolled steel sheet (hereinafter, this characteristic is referred to as "LME resistance").

Japanese Patent Application Publication No. 2018-145500 (Patent Literature 3) proposes a hot-dip Zn—Al—Mg-based plated steel sheet that has high strength and excellent workability and is also excellent in LME resistance.

The hot-dip Zn—Al—Mg-based plated steel sheet of Patent Literature 3 includes a blank steel sheet and a hot-dip Zn—Al—Mg-based alloy plating layer. The blank steel sheet has a chemical composition consisting of, in mass %, C: 0.01 to 0.08%, Si: 0.8% or less, Mn: 0.5 to 1.8%, P: 0.05% or less, S: 0.005% or less, N: 0.001 to 0.005%, Ti: 0.02 to 0.2%, B: 0.0005 to 0.010%, and Al: 0.005 to 0.1%, with the balance being Fe and unavoidable impurities. In the above chemical composition, a Ti/C equivalence ratio (=(Ti/48)/(C/12)) is 0.4 to 1.5. In the blank steel sheet, in addition, the dislocation density is $1.8\times10^{14}/m^2$ to $5.7\times10^{14}/m^2$. In the blank steel sheet, either one of a bainitic ferrite phase and a ferrite phase is a single phase, or a phase containing a bainitic ferrite phase and a ferrite phase is a principal phase, and the area fraction of a hard second phase and cementite is 3% or less. In addition, carbides containing Ti that have a mean particle diameter of 20 nm or less are dispersed and precipitated in the blank steel sheet.

Patent Literature 3 describes that by having the aforementioned chemical composition and microstructure, high strength, excellent workability, and excellent LME resistance are obtained in the hot-dip Zn—Al—Mg-based plated steel sheet.

CITATION LIST

Patent Literature

Patent Literature 1: Japanese Patent Application Publication No. 2018-003062

Patent Literature 2: Japanese Patent Application Publication No. 2017-179539

Patent Literature 3: Japanese Patent Application Publication No. 2018-145500

SUMMARY OF INVENTION

Technical Problem

In this connection, hot-rolled steel sheets may be required to have not only high strength, excellent workability, and excellent LME resistance in a case where a hot dip galvanized layer is formed, but are also required to have high rigidity. Although the aforementioned Patent Literature 1 to Patent Literature 3 discuss high strength, excellent workability, and excellent LME resistance in a case where a hot dip galvanized layer is formed, techniques for also obtaining high rigidity together with these characteristics are not discussed.

An objective of the present disclosure is to provide a hot-rolled steel sheet that has excellent rigidity together with high strength, excellent workability, and excellent LME resistance, a hot-dip coated steel sheet, and a method for producing a hot-rolled steel sheet.

Solution to Problem

A hot-rolled steel sheet, a hot-dip coated steel sheet, and a method for producing a hot-rolled steel sheet according to the present disclosure are as follows.

A hot-rolled steel sheet according to the present disclosure consists of, in mass %, C: 0.040 to 0.120%,
Si: 0.01 to 0.60%,
Mn: 0.50 to 1.50%,
P: 0.025% or less,
S: 0.010% or less,
Al: 0.010 to 0.070%,
N: 0.0070% or less,
Ti: 0.055 to 0.200%, and
B: 0.0010 to 0.0050%,
with the balance being Fe and impurities,
wherein:
in the microstructure, an area fraction of bainitic ferrite is 85% or more,
a dislocation density is $8.0\times10^{13}$ to $100.0\times10^{13}/m^2$,
an average equivalent circular diameter of Ti carbides in the hot-rolled steel sheet is 10 nm or less, and
an average equivalent circular diameter of grains of the bainitic ferrite is 15 μm or less.

A hot-rolled steel sheet according to the present disclosure contains, in mass %, C: 0.040 to 0.120%,
Si: 0.01 to 0.60%,
Mn: 0.50 to 1.50%,
P: 0.025% or less,
S: 0.010% or less,
Al: 0.010 to 0.070%,
N: 0.0070% or less,
Ti: 0.055 to 0.200%, and
B: 0.0010 to 0.0050%,
and further contains one or more kinds selected from a group consisting of a first group and a second group, with the balance being Fe and impurities,
wherein:
in the microstructure, an area fraction of bainitic ferrite is 85% or more, a dislocation density is $8.0\times10^{13}$ to $100.0\times10^{13}/m^2$,
an average equivalent circular diameter of Ti carbides in the hot-rolled steel sheet is 10 nm or less, and
an average equivalent circular diameter of grains of the bainitic ferrite is 15 μm or less;

[First Group]
one or more kinds of element selected from a group consisting of:
Nb: 0.20% or less, and
V: 0.20% or less;

[Second Group]
one or more kinds of element selected from a group consisting of:
Cr: 1.0% or less, and
Mo: 1.0% or less.

A hot-dip coated steel sheet according to the present disclosure includes:
the hot-rolled steel sheet described above, and
a hot dip galvanized layer which is formed on a surface of the hot-rolled steel sheet and which contains Zn in an amount of 65.00% or more by mass.

A method for producing a hot-rolled steel sheet according to the present disclosure includes:
a rough rolling process of subjecting a starting material to rough rolling using a rougher to produce a rough bar,
a finish rolling process of subjecting the rough bar to finish rolling using a finisher to produce a steel sheet, in which a rolling finishing temperature FT is set in a range of 850 to 950° C.,
a cooling process of cooling the steel sheet after the finish rolling is completed, and
a coiling process of coiling the steel sheet after the cooling process, at a coiling temperature of 470 to 620° C.,
wherein, in the cooling process:
cooling of the steel sheet using cooling equipment is started within three seconds after the finish rolling is completed,
and when a period from when cooling using the cooling equipment is started until the temperature of the steel sheet reaches a switching temperature ST is defined as an early-stage cooling period, and a period until the temperature of the steel sheet reaches the coiling temperature from the switching temperature ST is defined as a latter-stage cooling period,
an early-stage cooling rate CR1 that is a cooling rate in the early-stage cooling period is set to less than 25° C./sec,
the switching temperature ST is set to 730 to 830° C., and
a latter-stage cooling rate CR2 that is a cooling rate in the latter-stage cooling period is set to 25° C./sec or more.

Advantageous Effects of Invention

The hot-rolled steel sheet and the hot-dip coated steel sheet according to the present disclosure each have excellent rigidity as well as high strength, excellent workability, and excellent LME resistance. The method for producing a hot-rolled steel sheet according to the present disclosure can produce the aforementioned hot-rolled steel sheet.

DESCRIPTION OF EMBODIMENTS

Figure 1:
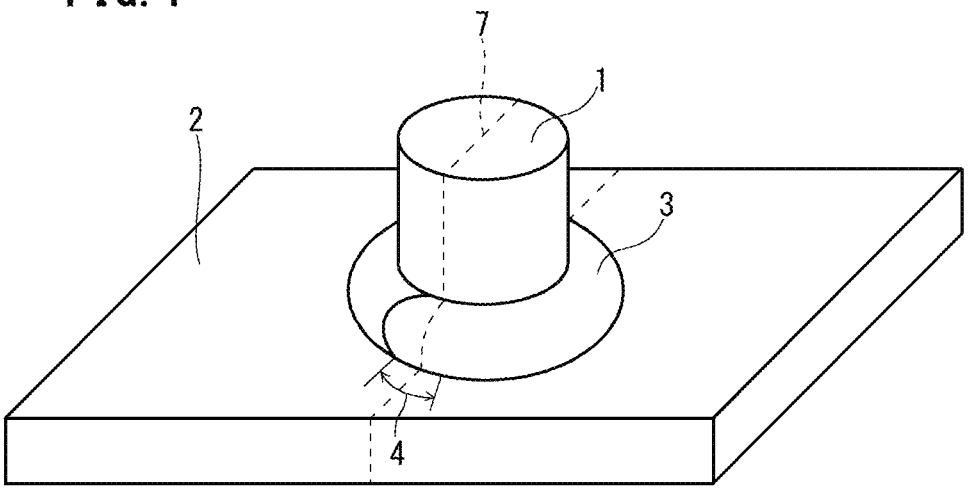
FIG. 1 is a schematic diagram illustrating an LME resistance evaluation test carried out in the Examples.

First, the present inventors conducted studies from the viewpoint of the chemical composition with respect to a hot-rolled steel sheet that has high strength, excellent workability, and excellent LME resistance. As a result, the present inventors considered that if the chemical composition of a hot-rolled steel sheet consists of, in mass %, C: 0.040 to 0.120%, Si: 0.01 to 0.60%, Mn: 0.50 to 1.50%, P: 0.025% or less, S: 0.010% or less, Al: 0.010 to 0.070%, N: 0.0070% or less, Ti: 0.055 to 0.200%, B: 0.0010 to 0.0050%, Nb: 0 to 0.20%, V: 0 to 0.20%, Cr: 0 to 1.0%, and Mo: 0 to 1.0%, with the balance being Fe and impurities, there is a possibility that high strength, excellent workability, and excellent LME resistance can be obtained.

Therefore, in order to obtain high strength, excellent workability, and excellent LME resistance, the present inventors conducted further studies regarding the microstructure of a hot-rolled steel sheet in which the content of each element in the chemical composition is within the above range. As a result, the present inventors discovered that if the following characteristics are satisfied in the microstructure of the hot-rolled steel sheet, high strength, excellent workability, and excellent LME resistance will be obtained.

Characteristic 1: The area fraction of bainitic ferrite in the microstructure is 85% or more.

Characteristic 2: The dislocation density is $8.0\times10^{13}$ to $100.0\times10^{13}/m^2$.

Characteristic 3: The average equivalent circular diameter of Ti carbides in the hot-rolled steel sheet is 10 nm or less.

However, even when hot-rolled steel sheets had a chemical composition in which the content of each element was within the aforementioned range and satisfied Characteristic 1 to Characteristic 3, there were still some cases where the rigidity was low. Therefore, the present inventors also conducted studies regarding means by which, in addition to having high strength, excellent workability, and excellent LME resistance, high rigidity can also be obtained. As a result, the present inventors newly found that, in a hot-rolled steel sheet in which the content of each element in the chemical composition is within the aforementioned range and which has Characteristic 1 to Characteristic 3, in addition to having high strength, excellent workability, and excellent LME resistance, high rigidity will also be obtained if the hot-rolled steel sheet also has the following Characteristic 4.

Characteristic 4: The average equivalent circular diameter of the grains of bainitic ferrite is 15 μm or less.

A hot-rolled steel sheet, a hot-dip coated steel sheet that uses the hot-rolled steel sheet, and a method for producing a hot-rolled steel sheet according to the present embodiment were completed based on the technical idea described above, and are as follows.

[1]

A hot-rolled steel sheet consisting of, in mass %,

C: 0.040 to 0.120%,

Si: 0.01 to 0.60%,

Mn: 0.50 to 1.50%,

P: 0.025% or less,

S: 0.010% or less,

Al: 0.010 to 0.070%,

N: 0.0070% or less,

Ti: 0.055 to 0.200%, and

B: 0.0010 to 0.0050%, with the balance being Fe and impurities, wherein:

in the microstructure, an area fraction of bainitic ferrite is 85% or more, a dislocation density is $8.0\times10^{13}$ to $100.0\times10^{13}/m^2$, an average equivalent circular diameter of Ti carbides in the hot-rolled steel sheet is 10 nm or less, and an average equivalent circular diameter of grains of the bainitic ferrite is 15 μm or less.

[2]

A hot-rolled steel sheet containing, in mass %,

C: 0.040 to 0.120%,

Si: 0.01 to 0.60%,

Mn: 0.50 to 1.50%,

P: 0.025% or less,

S: 0.010% or less,

Al: 0.010 to 0.070%,

N: 0.0070% or less,

Ti: 0.055 to 0.200%, and

B: 0.0010 to 0.0050%, and further containing one or more kinds selected from a group consisting of a first group and a second group, with the balance being Fe and impurities, wherein:

in the microstructure, an area fraction of bainitic ferrite is 85% or more, a dislocation density is $8.0\times10^{13}$ to $100.0\times10^{13}/m^2$, an average equivalent circular diameter of Ti carbides in the hot-rolled steel sheet is 10 nm or less, and an average equivalent circular diameter of grains of the bainitic ferrite is 15 μm or less;

[First Group]

one or more kinds of element selected from a group consisting of:

Nb: 0.20% or less, and

V: 0.20% or less;

[Second Group]

one or more kinds of element selected from a group consisting of:

Cr: 1.0% or less, and

Mo: 1.0% or less.

[3]

The hot-rolled steel sheet according to [2], containing:

the first group.

[4]

The hot-rolled steel sheet according to [2] or [3], containing:

the second group.

[5]

A hot-dip coated steel sheet, including:

the hot-rolled steel sheet according to any one of [1] to [4], and a hot dip galvanized layer which is formed on a surface of the hot-rolled steel sheet and which contains Zn in an amount of 65.00% or more by mass %.

[6]

A method for producing the hot-rolled steel sheet according to any one of [1] to [4], including:

a rough rolling process of subjecting a starting material to rough rolling using a rougher to produce a rough bar, a finish rolling process of subjecting the rough bar to finish rolling using a finisher to produce a steel sheet, in which a rolling finishing temperature FT is set in a range of 850 to 950° C., a cooling process of cooling the steel sheet after the finish rolling is completed, and a coiling process of coiling the steel sheet after the cooling process, at a coiling temperature of 470 to 620° C., wherein, in the cooling process:

cooling of the steel sheet using cooling equipment is started within three seconds after the finish rolling is completed, and when a period from when cooling using the cooling equipment is started until the temperature of the steel sheet reaches a switching temperature ST is defined as an early-stage cooling period, and a period until the temperature of the steel sheet reaches the coiling temperature from the switching temperature ST is defined as a latter-stage cooling period, an early-stage cooling rate CR1 that is a cooling rate in the early-stage cooling period is set to less than 25° C./second, the switching temperature ST is set to 730 to 830° C., and a latter-stage cooling rate CR2 that is a cooling rate in the latter-stage cooling period is set to 25° C./second or more.

Hereunder, the hot-rolled steel sheet and the hot-dip coated steel sheet according to the present embodiment are described in detail.

The symbol "%" in relation to an element means mass percent unless otherwise stated.

[Hot-Rolled Steel Sheet]

[Chemical Composition]

The chemical composition of the hot-rolled steel sheet according to the present embodiment contains the following elements.

C: 0.040 to 0.120%

Carbon (C) combines with Ti to forms Ti carbides. The Ti carbides increase the strength of the hot-rolled steel sheet by precipitation strengthening, and increase the workability. In addition, in a case where the content of Ti in the chemical composition is 0.055 to 0.200%, C facilitates the formation of bainitic ferrite. If the content of C is less than 0.040%, high strength will not be obtained even if the contents of other elements are within the range of the present embodiment. Specifically, it will be difficult for the tensile strength TS of the hot-rolled steel sheet to become 780 MPa or more. In addition, the dislocation density will become excessively high and the workability of the hot-rolled steel sheet will decrease.

On the other hand, if the content of C is more than 0.120%, polygonal ferrite will easily form in the microstructure even if the contents of other elements are within the range of the present embodiment. Consequently, the area fraction of bainitic ferrite in the hot-rolled steel sheet will decrease. Further, the dislocation density of the hot-rolled steel sheet will decrease. In addition, the average equivalent circular diameter of grains of bainitic ferrite will be large. As a result, the rigidity of the hot-rolled steel sheet will decrease.

Therefore, the content of C is to be 0.040 to 0.120%.

A preferable lower limit of the content of C is 0.042%, more preferably is 0.044%, and further preferably is 0.046%.

A preferable upper limit of the content of C is 0.115%, more preferably is 0.110%, and further preferably is 0.105%.

Si: 0.01 to 0.60%

Silicon (Si) deoxidizes the steel. Si also increases the strength of the hot-rolled steel sheet by solid-solution strengthening. If the content of Si is less than 0.01%, the aforementioned advantageous effects will not be sufficiently obtained even if the contents of other elements are within the range of the present embodiment.

On the other hand, if the content of Si is more than 0.60%, polygonal ferrite will easily form in the hot-rolled steel sheet even if the contents of other elements are within the range of the present embodiment. Consequently, the area fraction of bainitic ferrite in the hot-rolled steel sheet will decrease. Further, the dislocation density of the hot-rolled steel sheet will decrease. In addition, the average equivalent circular diameter of grains of bainitic ferrite will be large. As a result, the rigidity of the hot-rolled steel sheet will decrease.

Therefore, the content of Si is to be 0.01 to 0.60%.

A preferable lower limit of the content of Si is 0.02%, more preferably is 0.03%, and further preferably is 0.04%.

A preferable upper limit of the content of Si is 0.55%, more preferably is 0.50%, and further preferably is 0.45%.

Mn: 0.50 to 1.50%

Manganese (Mn) increases the strength of the hot-rolled steel sheet by solid-solution strengthening. If the content of Mn is less than 0.50%, the aforementioned advantageous effect will not be sufficiently obtained even if the contents of other elements are within the range of the present embodiment.

On the other hand, if the content of Mn is more than 1.50%, even if the contents of other elements are within the range of the present embodiment, Mn segregation will easily occur in the hot-rolled steel sheet. In addition, if the content of Mn is more than 1.50%, bainite will easily form in the hot-rolled steel sheet. Consequently, the area fraction of bainitic ferrite in the hot-rolled steel sheet will decrease, and the dislocation density will become excessively high. Therefore, the workability of the hot-rolled steel sheet will decrease.

Therefore, the content of Mn is to be 0.50 to 1.50%.

A preferable lower limit of the content of Mn is 0.55%, more preferably is 0.60%, and further preferably is 0.65%.

A preferable upper limit of the content of Mn is 1.40%, more preferably is 1.30%, and further preferably is 1.20%.

P: 0.025% or less

Phosphorus (P) is an impurity. P segregates to grain boundaries and decreases the workability of the hot-rolled steel sheet. P also decreases the weldability of the hot-rolled steel sheet. If the content of P is more than 0.025%, the workability and weldability of the hot-rolled steel sheet will markedly decrease even if the contents of other elements are within the range of the present embodiment.

Therefore, the content of P is to be 0.025% or less.

The content of P is preferably as low as possible. However, excessively reducing the content of P will lower productivity and increase the production cost. Therefore, when taking normal industrial production into consideration, a preferable lower limit of the content of P is more than 0%, more preferably is 0.001%, further preferably is 0.002%, and further preferably is 0.003%.

A preferable upper limit of the content of P is 0.023%, more preferably is 0.020%, and further preferably is 0.015%.

S: 0.010% or less

Sulfur (S) is an impurity. S segregates to grain boundaries and decreases the workability of the hot-rolled steel sheet. If the content of S is more than 0.010%, the workability of the hot-rolled steel sheet will markedly decrease even if the contents of other elements are within the range of the present embodiment.

Therefore, the content of S is to be 0.010% or less.

The content of S is preferably as low as possible. However, excessively reducing the content of S will lower productivity and increase the production cost. Therefore, when taking normal industrial production into consideration, a preferable lower limit of the content of S is more than 0%, further preferably is 0.001%, further preferably is 0.002%, and further preferably is 0.003%.

A preferable upper limit of the content of S is 0.009%, and more preferably is 0.008%.

Al: 0.010 to 0.070%

Aluminum (Al) deoxidizes the steel. Al also combines with N to form Al nitrides. By this means, Al suppresses combining of B with N. If the content of Al is less than 0.010%, the aforementioned advantageous effects will not be sufficiently obtained even if the contents of other elements are within the range of the present embodiment.

On the other hand, if the content of Al is more than 0.070%, coarse Al nitrides will excessively form even if the contents of other elements are within the range of the present embodiment. Consequently, the workability of the hot-rolled steel sheet will decrease.

Therefore, the content of Al is to be 0.010 to 0.070%.

A preferable lower limit of the content of Al is 0.012%, more preferably is 0.014%, and further preferably is 0.016%.

A preferable upper limit of the content of Al is 0.065%, more preferably is 0.060%, and further preferably is 0.055%.

N: 0.0070% or less

Nitrogen (N) is an impurity. N combines with B to form BN, and thereby reduces the amount of B dissolved in the hot-rolled steel sheet. N also combines with Ti to form TiN, and thereby inhibits the formation of Ti carbides. If the content of N is more than 0.0070%, excessive amounts of BN and TiN will form even if the contents of other elements are within the range of the present embodiment. As a result, the LME resistance of the hot-rolled steel sheet will decrease. In addition, the strength of the hot-rolled steel sheet will decrease.

Therefore, the content of N is to be 0.0070% or less.

The content of N is preferably as low as possible. However, excessively reducing the content of N will lower productivity and increase the production cost. Therefore, when taking normal industrial production into consideration, a preferable lower limit of the content of N is more than 0%, more preferably is 0.0001%, further preferably is 0.0005%, and further preferably is 0.0010%.

A preferable upper limit of the content of N is 0.0060%, more preferably is 0.0050%, and further preferably is 0.0040%.

Ti: 0.055 to 0.200%

Titanium (Ti) combines with C to form Ti carbides. The Ti carbides increase the strength of the hot-rolled steel sheet by precipitation strengthening. In addition, in a case where the content of C is 0.040 to 0.120%, if the content of Ti is appropriate, it will be easy for bainitic ferrite to form in the hot-rolled steel sheet. If the content of Ti is less than 0.055%, polygonal ferrite will easily form even if the contents of other elements are within the range of the present embodiment. Consequently, the area fraction of bainitic ferrite in the hot-rolled steel sheet will decrease, and the dislocation density of the hot-rolled steel sheet will also decrease. In addition, the average equivalent circular diameter of the grains of bainitic ferrite will be large. As a result, the rigidity of the hot-rolled steel sheet will decrease.

On the other hand, if the content of Ti is more than 0.200%, even if the contents of other elements are within the range of the present embodiment, the dislocation density in the hot-rolled steel sheet will be excessively high. As a result, the workability of the hot-rolled steel sheet will decrease.

Therefore, the content of Ti is to be 0.055 to 0.200%.

A preferable lower limit of the content of Ti is 0.060%, more preferably is 0.065%, further preferably is 0.070%, further preferably is 0.075%, further preferably is 0.080%, and further preferably is 0.085%.

A preferable upper limit of the content of Ti is 0.190%, more preferably is 0.180%, and further preferably is 0.170%.

B: 0.0010 to 0.0050%

Boron (B) dissolves in the hot-rolled steel sheet, and segregates to prior-austenite grain boundaries. The segregated B increases the grain boundary strength. Therefore, B increases the LME resistance of the hot-rolled steel sheet. B also increases the hardenability of the steel. If the content of B is less than 0.0010%, the LME resistance of the hot-rolled steel sheet will not be sufficiently obtained even if the contents of other elements are within the range of the present embodiment. In addition, because the hardenability will be insufficient, the dislocation density will decrease. Further, the area fraction of bainitic ferrite will decrease. In addition, the temperature at which transformation from austenite to ferrite starts will increase. In such case, the temperature at which precipitation of Ti carbides starts will also increase. Consequently, the Ti carbides will be coarse. As a result, the strength of the hot-rolled steel sheet will decrease, and the rigidity will also decrease.

On the other hand, if the content of B is more than 0.0050%, the hardenability will be excessively high even if the contents of other elements are within the range of the present embodiment. In such case, the dislocation density of the hot-rolled steel sheet will be excessively high. In addition, the area fraction of bainitic ferrite will decrease. As a result, the workability of the steel sheet will decrease. In addition, if the content of B is more than 0.0050%, the LME resistance will decrease.

Therefore, the content of B is to be 0.0010 to 0.0050%.

A preferable lower limit of the content of B is 0.0015%, more preferably is 0.0020%, and further preferably is 0.0025%.

A preferable upper limit of the content of B is 0.0045%, more preferably is 0.0040%, and further preferably is 0.0035%.

The balance of the chemical composition of the hot-rolled steel sheet of the present embodiment is Fe and impurities. Here, the term "impurities" refers to elements which are mixed in from ore and scrap as the raw material or from the production environment or the like when industrially producing the hot-rolled steel sheet, and which are not intentionally contained but are permitted within a range that does not adversely affect the hot-rolled steel sheet of the present embodiment.

[Optional Elements]

The chemical composition of the hot-rolled steel sheet of the present embodiment may further contain one or more kinds selected from the group consisting of a first group and a second group in lieu of a part of Fe.

[First Group]

One or more kinds of element selected from the group consisting of:

Nb: 0.20% or less, and

V: 0.20% or less.

[Second Group]

One or more kinds of element selected from the group consisting of:

Cr: 1.0% or less, and

Mo: 1.0% or less.

Each of these elements is an optional element. Hereunder, the first group and the second group are described.

[First Group: Nb and V]

The hot-rolled steel sheet of the present embodiment may contain the first group in lieu of a part of Fe. Each of these elements combines with C to form carbides, and thereby increases the strength of the hot-rolled steel sheet. Each element is described hereunder.

Nb: 0.20% or less

Niobium (Nb) is an optional element, and does not have to be contained. That is, the content of Nb may be 0%.

When contained, that is, when the content of Nb is more than 0%, Nb combines with C to form Nb carbides. The Nb carbides increase the strength of the hot-rolled steel sheet by precipitation strengthening. If even a small amount of Nb is contained, the aforementioned advantageous effect will be obtained to a certain extent.

However, if the content of Nb is more than 0.20%, Nb carbides will excessively form even if the contents of other elements are within the range of the present embodiment. In such case, the workability of the hot-rolled steel sheet will decrease.

Therefore, the content of Nb is to be 0 to 0.20%, and when contained, the content of Nb is to be 0.20% or less.

A preferable lower limit of the content of Nb is 0.01%, more preferably is 0.05%, and further preferably is 0.08%.

A preferable upper limit of the content of Nb is 0.18%, more preferably is 0.16%, and further preferably is 0.14%.

V: 0.20% or less

Vanadium (V) is an optional element, and does not have to be contained. That is, the content of V may be 0%.

When contained, that is, when the content of V is more than 0%, V combines with C to form V carbides. The V carbides increase the strength of the hot-rolled steel sheet by precipitation strengthening. If even a small amount of V is contained, the aforementioned advantageous effect will be obtained to a certain extent.

However, if the content of V is more than 0.20%, V carbides will excessively form even if the contents of other elements are within the range of the present embodiment. In such case, the workability of the hot-rolled steel sheet will decrease.

Therefore, the content of V is to be 0 to 0.20%, and when contained, the content of V is to be 0.20% or less.

A preferable lower limit of the content of V is 0.01%, more preferably is 0.05%, and further preferably is 0.08%.

A preferable upper limit of the content of V is 0.18%, more preferably is 0.16%, and further preferably is 0.14%.

[Second Group: Cr and Mo]

The hot-rolled steel sheet of the present embodiment may contain the second group in lieu of a part of Fe. Each of these elements increases the LME resistance of the hot-rolled steel sheet. Each element is described hereunder.

Cr: 1.0% or less

Chromium (Cr) is an optional element, and does not have to be contained. That is, the content of Cr may be 0%.

When contained, that is, when the content of Cr is more than 0%, Cr segregates to prior-austenite grain boundaries, and thereby increases the LME resistance of the hot-rolled steel sheet. If even a small amount of Cr is contained, the aforementioned advantageous effect will be obtained to a certain extent.

However, if the content of Cr is more than 1.0%, the workability of the hot-rolled steel sheet will decrease even if the contents of other elements are within the range of the present embodiment.

Therefore, the content of Cr is to be 0 to 1.0%, and when contained, the content of Cr is to be 1.0% or less.

A preferable lower limit of the content of Cr is 0.1%, more preferably is 0.2%, and further preferably is 0.3%.

A preferable upper limit of the content of Cr is 0.9%, more preferably is 0.8%, and further preferably is 0.7%.

Mo: 1.0% or less

Molybdenum (Mo) is an optional element, and does not have to be contained. That is, the content of Mo may be 0%. When contained, that is, when the content of Mo is more than 0%, Mo segregates to prior-austenite grain boundaries, and thereby increases the LME resistance of the hot-rolled steel sheet. If even a small amount of Mo is contained, the aforementioned advantageous effect will be obtained to a certain extent.

However, if the content of Mo is more than 1.0%, the workability of the hot-rolled steel sheet will decrease even if the contents of other elements are within the range of the present embodiment.

Therefore, the content of Mo is to be 0 to 1.0%, and when contained, the content of Mo is to be 1.0% or less.

A preferable lower limit of the content of Mo is 0.1%, more preferably is 0.2%, and further preferably is 0.3%.

A preferable upper limit of the content of Mo is 0.9%, more preferably is 0.8%, and further preferably is 0.7%.

[Method for Measuring Chemical Composition of Hot-Rolled Steel Sheet]

The chemical composition of the hot-rolled steel sheet of the present embodiment can be measured by a well-known composition analysis method in accordance with JIS G0321: 2017. Specifically, machined chips are collected from the hot-rolled steel sheet using a cutting tool such as a drill. The collected machined chips are dissolved in acid to obtain a liquid solution. The liquid solution is subjected to ICP-MAS (Inductively Coupled Plasma Mass Spectrometry) to perform elemental analysis of the chemical composition. The content of C and the content of S are determined by a well-known high-frequency combustion method (combustion-infrared absorption method). The content of N is determined using a well-known inert gas fusion-thermal conductivity method.

Note that, a numerical value up to the least significant digit of the content of each element defined in the present embodiment that is obtained by rounding off a fraction of the measured numerical value based on the significant figures defined in the present embodiment is adopted for the content of each element. For example, the content of C in the steel material of the present embodiment is defined as a numerical value up to the thousandths place. Therefore, the content of C is taken as a numerical value up to the thousandths place that is obtained by rounding off the ten-thousandths place of the measured numerical value.

Similarly, for the content of each element other than the content of C in the steel material of the present embodiment also, a value obtained by rounding off a fraction of the measured numerical value up to the least significant digit defined in the present embodiment is taken as the content of the relevant element.

Note that, the term "rounding off" means rounding down if the fraction is less than 5, and rounding up if the fraction is 5 or more.

[Characteristics Other than Chemical Composition of Hot-Rolled Steel Sheet of Present Embodiment]

In the hot-rolled steel sheet of the present embodiment, the content of each element in the chemical composition is within the range of the present embodiment, and the following Characteristic 1 to Characteristic 4 are satisfied.

Characteristic 1: The area fraction of bainitic ferrite in the microstructure is 85% or more.

Characteristic 2: The dislocation density is $8.0\times10^{13}$ to $100.0\times10^{13}/m^2$.

Characteristic 3: The average equivalent circular diameter of Ti carbides in the hot-rolled steel sheet is 10 nm or less.

Characteristic 4: The average equivalent circular diameter of the grains of bainitic ferrite is 15 μm or less.

Each characteristic is described hereunder.

[Characteristic 1: Area Fraction of Bainitic Ferrite]

In the microstructure of the hot-rolled steel sheet of the present embodiment, the area fraction of bainitic ferrite is 85% or more. The microstructure of the hot-rolled steel sheet of the present embodiment may be a bainitic-ferrite single phase microstructure. In a case where the microstructure of the hot-rolled steel sheet of the present embodiment is composed of bainitic ferrite and one or more other phases, the other phases are, for example, one or more kinds selected from the group consisting of polygonal ferrite, pearlite, bainite, and cementite.

Bainitic ferrite can be distinguished from polygonal ferrite and bainite in the following respects.

[Distinguishing Between Bainitic Ferrite and Polygonal Ferrite]

Bainitic ferrite is an aggregation of grains having slightly different crystal orientations to each other. Therefore, a difference in the contrast within the grains is discernible. On the other hand, polygonal ferrite is a structure in which there is almost no crystal orientation difference within the grains. Therefore, the interiors of the grains are observed with a uniform contrast. Therefore, bainitic ferrite can be distinguished from polygonal ferrite based on contrast that is attributable to crystal orientation differences.

[Distinguishing Between Bainitic Ferrite and Bainite]

The crystal structure of bainitic ferrite is a bcc structure, similarly to the crystal structure of bainite. Hence, it is difficult to distinguish bainitic ferrite from bainite based on crystal structure. In addition, it is difficult to distinguish bainitic ferrite from bainite based on crystal orientation difference. However, bainitic ferrite can be distinguished from bainite based on whether or not Fe carbides are present within grains and at grain boundaries. Here, the term "Fe carbides" refers to carbides that contain Fe, such as cementite.

Specifically, in bainitic ferrite, Fe carbides are not present within grains and at grain boundaries. On the other hand, in bainite, Fe carbides are present within laths and/or at lath boundaries. Therefore, bainitic ferrite can be distinguished from bainite based on whether or not Fe carbides are present within grains and at grain boundaries.

[Advantageous Effects Produced by Area Fraction of Bainitic Ferrite]

In the microstructure of a hot-rolled steel sheet in which the content of each element in the chemical composition is within the range of the present embodiment, if the area fraction of bainitic ferrite is 85% or more, on the precondition that the other Characteristics 2 to 4 are satisfied, high strength and high rigidity will be obtained.

A preferable lower limit of the area fraction of bainitic ferrite is 88%, more preferably is 90%, further preferably is 92%, further preferably is 94%, and further preferably is 96%.

[Method for Measuring Area Fraction of Bainitic Ferrite]

The area fraction of bainitic ferrite can be determined by the following method.

Microstructure observation is performed using a field emission scanning electron microscope (FE-SEM). The microstructure observation is performed using an electron channeling contrast image (ECCI). The observation conditions are to be set as follows: acceleration voltage of 20 kV, tilt (T)=0°, and backscattered electron mode. Electron back scatter diffraction (EBSD) is used as the method for measuring the crystal orientation.

A test specimen is taken from a central position of the width of the hot-rolled steel sheet. The measurement position is to be a position at a depth of ¼ of the thickness in the thickness direction of the hot-rolled steel sheet from the surface of the test specimen, with the measurement range set to 100 μm×100 μm, and the measurement interval set to 0.1 μm. The measurement range is to a longitudinal section that includes an L direction (longitudinal direction of hot-rolled steel sheet) and a T direction (thickness direction of hot-rolled steel sheet).

The measurement data is analyzed by the following procedures using analysis software to identify and quantify polygonal ferrite and bainitic ferrite.

(Procedure 1)

A region surrounded by grain boundaries of 15° or more is defined as a single grain. Note that, in a case where the equivalent circular diameter of a region surrounded by grain boundaries of 15° or more is 1.0 μm or less, it is determined that the region is measurement noise, and the region is not recognized as a grain. In other words, regions which are determined as being measurement noise are excluded from the analysis.

(Procedure 2)

An average value of the crystal orientation differences within each grain (grain average misorientation: hereinafter, referred to as "GAM value") is calculated. Grains in which the GAM value is 0.5° or less are defined as polygonal ferrite. Grains in which the GAM value is more than 0.5° are defined as bainitic ferrite.

Note that, in the microstructure observation described above, phases which are different from bainitic ferrite and polygonal ferrite (that is, pearlite, bainite, and cementite) can be easily distinguished by contrast.

The identified bainitic ferrite is quantified. The area fraction of bainitic ferrite (%) is then determined based on the area of the quantified bainitic ferrite and the total area of the measurement range (100 μm×100 μm). Note that, regions which were determined to be measurement noise are excluded from the total area of the measurement range.

Note that, it suffices to use a well-known program as an EBSD analysis program for determining the GAM values. For example, OIM Data Collection/Analysis 6.2.0 manufactured by TSL Solutions KK may be used.

[Characteristic 2: Dislocation Density]

In the hot-rolled steel sheet of the present embodiment, in addition, the dislocation density is $8.0\times10^{13}$ to $100.0\times10^{13}/m^2$.

The higher that the dislocation density is, the higher that the rigidity of the hot-rolled steel sheet becomes. As mentioned above, the strain amount of bainitic ferrite is higher than the strain amount of polygonal ferrite. Therefore, the dislocation density of bainitic ferrite is higher than the dislocation density of polygonal ferrite. Therefore, in the microstructure of a hot-rolled steel sheet, if the area fraction of bainitic ferrite is 85% or more, the dislocation density will be high and the strength of the hot-rolled steel sheet will be high. However, even if a hot-rolled steel sheet in which the content of each element in the chemical composition is within the range of the present embodiment satisfies Characteristic 1, Characteristic 3, and Characteristic 4, if the dislocation density is too low, the rigidity will not be sufficiently high.

On the other hand, even if a hot-rolled steel sheet in which the content of each element in the chemical composition is within the range of the present embodiment satisfies Characteristic 1, Characteristic 3, and Characteristic 4, if the dislocation density is too high, the workability of the hot-rolled steel sheet will decrease.

If the dislocation density of a hot-rolled steel sheet in which the content of each element in the chemical composition is within the range of the present embodiment is $8.0\times10^{13}$ to $100.0\times10^{13}/m^2$, on the precondition that Characteristic 1, Characteristic 3, and Characteristic 4 are satisfied, excellent workability and excellent LME resistance will be obtained, and high strength and high rigidity will also be obtained.

A preferable lower limit of the dislocation density is $10.0\times10^{13}/m^2$, more preferably is $15.0\times10^{13}/m^2$, and further preferably is $20.0\times10^{13}/m^2$.

A preferable upper limit of the dislocation density is $90.0\times10^{13}/m^2$, more preferably is $80.0\times10^{13}/m^2$, and further preferably is $70.0\times10^{13}/m^2$.

[Method for Measuring Dislocation Density]

The dislocation density of the hot-rolled steel sheet of the present embodiment can be determined by the following method.

A test specimen for dislocation density measurement is taken from a central position of the width of the hot-rolled steel sheet. The dimensions of the test specimen are to be 20 mm in width×20 mm in length×the same thickness as the sheet thickness.

The surface of the test specimen is subjected to polishing using #80 to #1500 sandpaper from the surface to a position at a depth of ¼ of the thickness, and buffing is then performed to obtain a mirror finish. In addition, the test specimen after the mirror polishing is subjected to electropolishing of 50 μm or more in the thickness direction using 10 vol % perchloric acid (acetic acid solvent) to remove strain in the outer layer of the test specimen. The surface (observation surface) of the test specimen after the electropolishing is subjected to X-ray diffraction (XRD) to determine a half-value width ΔK of peaks of the (110), (211), and (220) planes of the body-centered cubic structure (bcc structure).

In the XRD, measurement of the half-value width ΔK is performed by employing CoKα ray as the radiation source, 30 kV as the tube voltage, and 100 mA as the tube current. In addition, $LaB_6$ (lanthanum hexaboride) powder is used to measure a half-value width originating from the X-ray diffractometer.

The heterogeneous strain a of the test specimen is determined based on the half-value width ΔK determined by the aforementioned method and the Williamson-Hall equation (Equation (I)).

$$\Delta K\times\cos\theta/\lambda=0.9/D+2\varepsilon\times\sin\theta/\lambda \quad \text{(I)}$$

Where, in Equation (I), θ represents the diffraction angle (°), λ represents the wavelength (nm) of the X-ray, and D represents the crystallite size (nm).

The dislocation density ρ ($/m^2$) is determined using the determined heterogeneous strain a and Equation (II).

$$\rho=14.4\times\varepsilon^2/b^2 \quad \text{(II)}$$

Where, in Equation (II), b represents the Burgers vector (b=0.248 (nm)) of the body-centered cubic structure (iron).

[Characteristic 3: Average Equivalent Circular Diameter of Ti Carbides]

In the hot-rolled steel sheet of the present embodiment, in addition, the average equivalent circular diameter of Ti carbides in the hot-rolled steel sheet is 10 nm or less. Here, the term "equivalent circular diameter" means the diameter of a circle having the same area as the area of the Ti carbide.

As mentioned above, Ti carbides increase the strength of a hot-rolled steel sheet by precipitation strengthening. In a hot-rolled steel sheet in which the content of each element in the chemical composition is within the range of the present embodiment, if the average equivalent circular diameter of Ti carbides is more than 10 nm, the Ti carbides in the hot-rolled steel sheet will be coarse. If the Ti carbides are coarse, sufficient precipitation strengthening will not be obtained. As a result, the strength of the hot-rolled steel sheet will not be sufficiently high.

In a hot-rolled steel sheet in which the content of each element in the chemical composition is within the range of the present embodiment, if the average equivalent circular diameter of Ti carbides is 10 nm or less, on the precondition that the other Characteristics 1, 2, and 4 are satisfied, high strength and high rigidity will be obtained while maintaining excellent workability and excellent LME resistance.

A preferable upper limit of the average equivalent circular diameter of Ti carbides is 9 nm, and more preferably is 8 nm.

The lower limit of the average equivalent circular diameter of Ti carbides is not particularly limited. A preferable lower limit of the average equivalent circular diameter of Ti carbides is 2 nm, more preferably is 3 nm, further preferably is 4 nm, and further preferably is 5 nm.

[Method for Measuring Average Equivalent Circular Diameter of Ti Carbides]

The average equivalent circular diameter of Ti carbides can be determined by the following method. A sample having the same thickness as the hot-rolled steel sheet is taken from a central position of the width of the hot-rolled steel sheet. Grinding and polishing are performed from both sides of the sample using emery paper to prepare a sample having a thickness of 50 μm which is centered on a position at a depth of ¼ of the thickness from the surface. Thereafter, a disk-shaped sample of 3 mm in diameter is extracted. The disk-shaped sample is immersed in 10% perchloric acid-glacial acetic acid solution to perform electropolishing and thereby prepare a thin film sample having a thickness of 100 nm.

Five visual fields on the observation surface of the prepared thin film sample are observed using a transmission electron microscope (TEM). The magnification is set to ×600,000. The size of each visual field is set to 200 nm×170 nm.

In each visual field, precipitates are identified based on contrast. The identified precipitates are subjected to composition analysis by EDS. Precipitates in which Ti and C are detected as a result of the analysis by EDS are identified as Ti carbides. The equivalent circular diameter of each identified Ti carbide is determined. An arithmetic average value of the equivalent circular diameters of all the Ti carbides confirmed in the five visual fields is defined as the average equivalent circular diameter of the Ti carbides (nm).

[Characteristic 4: Average Equivalent Circular Diameter of Grains of Bainitic Ferrite]

In the microstructure of the hot-rolled steel sheet of the present embodiment, in addition, the average equivalent circular diameter of the grains of bainitic ferrite is 15 μm or less. Here, the term "equivalent circular diameter" means the diameter of a circle having the same area as the area of the grain.

The size of the grains of bainitic ferrite strongly influences the rigidity. In a hot-rolled steel sheet in which the content of each element in the chemical composition is within the range of the present embodiment, even if Characteristic 1 to Characteristic 3 are satisfied, if the equivalent circular diameter of the grains of bainitic ferrite is more than 15 μm, although high strength, excellent workability, and excellent LME resistance will be obtained, sufficient rigidity will not be obtained.

In a hot-rolled steel sheet in which the content of each element in the chemical composition is within the range of the present embodiment, if the average equivalent circular diameter of the grains of bainitic ferrite is 15 μm or less, on the precondition that the other Characteristics 1 to 3 are satisfied, high rigidity will be obtained together with high strength, excellent workability, and excellent LME resistance.

A preferable upper limit of the average equivalent circular diameter of the grains of bainitic ferrite is 14 μm, more preferably is 13 μm, and further preferably is 12 μm.

The lower limit of the average equivalent circular diameter of the grains of bainitic ferrite is not particularly limited. A preferable lower limit of the average equivalent circular diameter of the grains of bainitic ferrite is 1 μm, more preferably is 2 μm, further preferably is 3 μm, and further preferably is 5 μm.

[Method for Measuring Equivalent Circular Diameter of Grains of Bainitic Ferrite]

The equivalent circular diameter of the grains of bainitic ferrite in the hot-rolled steel sheet can be determined by the following method. The equivalent circular diameter of each grain of bainitic ferrite identified by microstructure observation is determined by the method described in the above [Method for measuring area fraction of bainitic ferrite]. The arithmetic average value of the obtained equivalent circular diameters is defined as the average equivalent circular diameter (μm) of the grains of bainitic ferrite. Note that, in a case where the equivalent circular diameter of a region surrounded by grain boundaries of 15° or more is 1.0 μm or less, it is determined that the region is measurement noise, and the region is not recognized as a grain. In other words, if the equivalent circular diameter of a region surrounded by grain boundaries of 150 or more is 1.0 μm or less, the relevant region is excluded from the objects of the measurement.

As described above, the hot-rolled steel sheet of the present embodiment has a chemical composition in which the content of each element is within the range described above, and in addition, satisfies Characteristic 1 to Characteristic 4. Therefore, the hot-rolled steel sheet of the present embodiment has high strength and excellent workability, and in a case where a hot dip galvanized layer is formed on the surface of the hot-rolled steel sheet, has excellent LME resistance and, in addition, has high rigidity.

Specifically, in the hot-rolled steel sheet of the present embodiment, the tensile strength, which is an index of strength, is 780 MPa or more. Further, the total elongation, which is an index of workability, is 14.0% or more. In addition, the yield ratio, which is an index of rigidity, is 85% or more.

A preferable lower limit of the tensile strength of the hot-rolled steel sheet is 785 MPa, more preferably is 790 MPa, further preferably is 795 MPa, and further preferably is 800 MPa. Although not particularly limited, the upper limit of the tensile strength of the hot-rolled steel sheet is, for example, 950 MPa.

A preferable lower limit of the total elongation of the hot-rolled steel sheet is 14.5%, more preferably is 15.0%, and further preferably is 15.5%. Although not particularly limited, the upper limit of the total elongation of the hot-rolled steel sheet is, for example, 20.0%.

A preferable lower limit of the yield ratio of the hot-rolled steel sheet is 86%, more preferably is 87%, further preferably is 88%, and further preferably is 89%.

[Method for Measuring Tensile Strength, Total Elongation, and Yield Ratio]

The tensile strength, total elongation, and yield ratio of a hot-rolled steel sheet can be determined by a tensile test in accordance with JIS Z 2241: 2011.

Specifically, a sheet-shaped tensile test specimen corresponding to a JIS No. 5 test coupon specified in JIS Z 2241: 2011 is taken from a central position of the width of the hot-rolled steel sheet. The longitudinal direction of the test specimen is to be a direction orthogonal to the rolling direction of the hot-rolled steel sheet. In accordance with JIS Z 2241: 2011, a tensile test is conducted at normal temperature in air, and a yield strength YS, a tensile strength TS, and a total elongation T.EL are determined. At such time, the 0.2% proof stress is defined as the yield strength YS (MPa). The obtained yield strength YS (MPa) and tensile strength TS (MPa) are used to determine the yield ratio YR by the following equation.

$$\text{Yield ratio } YR = YS/TS$$

[Regarding Hot-Dip Coated Steel Sheet which Uses Hot-Rolled Steel Sheet of Present Embodiment]

The hot-dip coated steel sheet of the present embodiment includes the hot-rolled steel sheet of the present embodiment that is described above, and a hot dip galvanized layer that principally contains Zn. The hot dip galvanized layer is formed on the surface of the hot-rolled steel sheet. The hot dip galvanized layer has a known composition. Hereunder, the hot dip galvanized layer is described.

[Regarding Hot Dip Galvanized Layer]

As mentioned above, the hot dip galvanized layer principally contains Zn. Specifically, the hot dip galvanized layer contains Zn in an amount of 65.00% by mass or more. The hot dip galvanized layer may be a layer composed of a so-called "hot-dip galvanized coating" (GI). A hot-dip galvanized coating contains elements other than Zn in an amount of 1.00% by mass or less, with the balance being Zn. As long as the Zn content of the hot dip galvanized layer is 65.00% or more by mass, sufficient corrosion resistance will be obtained. A preferable lower limit of the Zn content of the hot dip galvanized layer is 70.00%, and more preferably is 73.00%.

[Regarding Chemical Composition of Hot Dip Galvanized Layer]

The hot dip galvanized layer may have a chemical composition other than GI. It suffices that the chemical composition of the hot dip galvanized layer is within a well-known range. For example, the chemical composition of the hot dip galvanized layer contains the following elements.

[Essential Element]

Al: 0.05 to 35.00%

Aluminum (Al) is an easily oxidized element, and increases the corrosion resistance of the hot dip galvanized layer by sacrificial protection. If the content of Al is 0.05 to 35.00%, the aforementioned advantageous effect will be sufficiently obtained.

A preferable lower limit of the content of Al is 0.08%, more preferably is 0.10%, and further preferably is 0.15%. A preferable upper limit of the content of Al is 33.00%, more preferably is 30.00%, further preferably is 28.00%, further preferably is 25.00%, further preferably is 23.00%, and further preferably is 21.00%.

The balance of the chemical composition of the hot dip galvanized layer according to the present embodiment is Zn and impurities. Here, the term "impurities" refers to substances which are mixed in from the raw material when performing a hot-dip galvanizing treatment, and are substances which are not intentionally contained.

[Regarding Optional Elements]

The chemical composition of the hot dip galvanized layer according to the present embodiment may further contain one or more elements selected from the following first group to seventh group in lieu of a part of Zn. Hereunder, the first group to seventh group are described.

[First group] Mg: 30.0% or less

[Second group (Sn group)] One or more kinds of element selected from the group consisting of Sn: 2.00% or less, Bi: 2.00% or less, and In: 2.00% or less

[Third group (Ca group)] One or more kinds of element selected from the group consisting of Ca: 3.00% or less, Y: 3.00% or less, La: 3.00% or less, and Ce: 3.00% or less

[Fourth group] Si: 2.50% or less

[Fifth group (Cr group)] One or more kinds of element selected from the group consisting of Cr: 0.5% or less, Ti: 0.5% or less, Ni: 0.5% or less, Co: 0.5% or less, V: 0.5% or less, Nb: 0.5% or less, Cu: 0.5% or less, and Mn: 0.5% or less

[Sixth group] Fe: 5.0% or less

[Seventh group (Sr group)] One or more kinds of element selected from the group consisting of Sr: 0.5% or less, Sb: 0.5% or less, Pb: 0.5% or less, and B: 0.5% or less

[First Group (Mg)]

Mg: 30.0% or less

Magnesium (Mg) is an optional element, and does not have to be contained. That is, the content of Mg may be 0%.

Mg is an easily oxidized element, and increases the corrosion resistance of the hot dip galvanized layer by sacrificial protection. If even a small amount of Mg is contained, the aforementioned advantageous effect will be obtained to a certain extent.

However, if the content of Mg is too high, oxidized dross will increase even if the contents of other elements are within the range of the present embodiment. In such case, the external appearance quality of the hot-dip coated steel sheet will decrease.

Therefore, the content of Mg is to be 0 to 30.0%, and when contained, the content of Mg is to be 30.0% or less.

A preferable lower limit of the content of Mg is more than 0%, more preferably is 0.1%, further preferably is 0.5%, further preferably is 1.0%, and further preferably is 2.0%.

A preferable upper limit of the content of Mg is 25.0%, more preferably is 20.0%, further preferably is 15.0%, further preferably is 10.0%, further preferably is 8.0%, and further preferably is 7.0%.

[Second Group (Sn, Bi, and In)]

One or more kinds of element selected from the group consisting of Sn: 2.00% or less, Bi: 2.00% or less, and In: 2.00% or less Tin (Sn), bismuth (Bi), and indium (In) are optional elements, and do not have to be contained. That is, the content of Sn, the content of Bi, and the content of In may each be 0%.

In a case where the hot dip galvanized layer contains Mg, these elements form intermetallic compounds with Mg. As a result, the corrosion resistance of the hot-dip coated steel sheet increases. If even a small amount of any one kind or more among Sn, Bi, and In is contained, the aforementioned advantageous effect will be obtained to a certain extent.

However, if the content of these elements is too high, the viscosity of the hot-dip galvanizing bath will increase even if the contents of other elements are within the range of the present embodiment. In such case, the external appearance quality of the hot-dip coated steel sheet will decrease.

Therefore, the content of Sn is to be 0 to 2.00%, the content of Bi is to be 0 to 2.00%, and the content of In is to be 0 to 2.00%. When contained, the content of Sn is to be 2.00% or less, the content of Bi is to be 2.00% or less, and the content of In is to be 2.00% or less.

A preferable lower limit of the content of each of these elements is more than 0%, more preferably is 0.01%, and further preferably is 0.05%.

A preferable upper limit of the content of each of these elements is 1.90%, more preferably is 1.80%, and further preferably is 1.70%.

[Third Group (Ca, Y, La, and Ce)]

One or more kinds of element selected from the group consisting of Ca: 3.00% or less, Y: 3.00% or less, La: 3.00% or less, and Ce: 3.00% or less Calcium (Ca), yttrium (Y), lanthanum (La), and cerium (Ce) are each optional elements, and do not have to be contained. That is, the content of each of these elements may be 0%.

These elements form intermetallic compounds with Al and Zn in the hot dip galvanized layer. As a result, the corrosion resistance of the hot-dip coated steel sheet increases. If even a small amount of one or more of these elements is contained, the aforementioned advantageous effect will be obtained to a certain extent.

However, if the content of these elements is too high, oxidized dross will increase even if the contents of other elements are within the range of the present embodiment. In such case, the external appearance quality of the hot-dip coated steel sheet will decrease.

Therefore, the content of Ca is to be 0 to 3.00%, the content of Y is to be 0 to 3.00%, the content of La is to be 0 to 3.00%, and the content of Ce is to be 0 to 3.00%. When contained, the content of Ca is to be 3.00% or less, the content of Y is to be 3.00% or less, the content of La is to be 3.00% or less, and the content of Ce is to be 3.00% or less.

A preferable lower limit of the content of each of these elements is more than 0%, more preferably is 0.01%, further preferably is 0.05%, and further preferably is 0.10%.

A preferable upper limit of the content of each of these elements is 2.80%, more preferably is 2.50%, and further preferably is 2.00%.

[Fourth Group (Si)]

Si: 2.50% or less

Silicon (Si) is an optional element, and does not have to be contained. That is, the content of Si may be 0%.

Si increases the corrosion resistance of the hot-dip coated steel sheet. If even a small amount of Si is contained, the aforementioned advantageous effect will be obtained to a certain extent.

However, if the content of Si is too high, the viscosity of the hot-dip galvanizing bath will increase even if the contents of other elements are within the range of the present embodiment. In such case, the external appearance quality of the hot-dip coated steel sheet will decrease.

Therefore, the content of Si is to be 0 to 2.50%, and when contained, the content of Si is to be 2.50% or less.

A preferable lower limit of the content of Si is more than 0%, more preferably is 0.01%, further preferably is 0.05%, and further preferably is 0.10%.

A preferable upper limit of the content of Si is 2.00%, more preferably is 1.50%, further preferably is 1.00%, and further preferably is 0.50%.

[Fifth Group (Cr, Ti, Ni, Co, V, Nb, Cu, and Mn)]

One or more kinds of element selected from the group consisting of Cr: 0.5% or less, Ti: 0.5% or less, Ni: 0.5% or less, Co: 0.5% or less, V: 0.5% or less, Nb: 0.5% or less, Cu: 0.5% or less, and Mn: 0.5% or less Chromium (Cr), titanium (Ti), nickel (Ni), cobalt (Co), vanadium (V), niobium (Nb), copper (Cu), and manganese (Mn) are each an optional element, and these elements do not have to be contained. That is, the content of these elements may be 0%.

These elements enhance the external appearance quality of the hot-dip coated steel sheet. These elements also form intermetallic compounds with Al in the hot dip galvanized layer. As a result, the corrosion resistance of the hot-dip coated steel sheet increases. If even a small amount of these elements is contained, the aforementioned advantageous effects will be obtained to a certain extent.

However, if the content of these elements is too high, the viscosity of the hot-dip galvanizing bath will increase even if the contents of other elements are within the range of the present embodiment. In such case, the external appearance quality of the hot-dip coated steel sheet will decrease.

Therefore, the content of Cr is to be 0 to 0.5%, the content of Ti is to be 0 to 0.5%, the content of Ni is to be 0 to 0.5%, the content of Co is to be 0 to 0.5%, the content of V is to be 0 to 0.5%, the content of Nb is to be 0 to 0.5%, the content of Cu is to be 0 to 0.5%, and the content of Mn is to be 0 to 0.5%. When contained, the content of Cr is to be 0.5% or less, the content of Ti is to be 0.5% or less, the content of Ni is to be 0.5% or less, the content of Co is to be 0.5% or less, the content of V is to be 0.5% or less, the content of Nb is to be 0.5% or less, the content of Cu is to be 0.5% or less, and the content of Mn is to be 0.5% or less.

A preferable lower limit of the content of each of these elements is more than 0%, and more preferably is 0.1%.

A preferable upper limit of the content of each of these elements is less than 0.5%, and more preferably is 0.4%.

[Sixth Group (Fe)]

Fe: 5.0% or less

Iron (Fe) is an optional element, and does not have to be contained. That is, the content of Fe may be 0%.

Fe increases the hardness of the hot dip galvanized layer, and increases the workability of the hot-dip coated steel sheet. If even a small amount of Fe is contained, the aforementioned advantageous effect will be obtained to a certain extent.

However, if the content of Fe is too high, the hardness of the hot dip galvanized layer will be too high even if the contents of other elements are within the range of the present embodiment. In such case, the workability of the hot-dip coated steel sheet will, on the contrary, decrease.

Therefore, the content of Fe is to be 0 to 5.0%, and when contained, the content of Fe is to be 5.0% or less.

A preferable lower limit of the content of Fe is more than 0%, more preferably is 0.1%, and further preferably is 0.5%.

A preferable upper limit of the content of Fe is 4.5%, more preferably is 4.0%, and further preferably is 3.5%.

[Seventh Group (Sr, Sb, Pb, and B)]

One or more kinds of element selected from the group consisting of Sr: 0.5% or less, Sb: 0.5% or less, Pb: 0.5% or less, and B: 0.5% or less Strontium (Sr), antimony (Sb), lead (Pb) and boron (B) are each an optional element, and these elements do not have to be contained. That is, the content of these elements may be 0%.

These elements increase the metallic luster of the hot dip galvanized layer, and thereby enhance the external appearance quality of the hot-dip coated steel sheet. If even a small amount of these elements is contained, the aforementioned advantageous effect will be obtained to a certain extent.

However, if the content of these elements is too high, oxidized dross will increase even if the contents of other elements are within the range of the present embodiment. In such case, the external appearance quality of the hot-dip coated steel sheet will decrease.

Therefore, the content of Sr is to be 0 to 0.5%, the content of Sb is to be 0 to 0.5%, the content of Pb is to be 0 to 0.5%, and the content of B is to be 0 to 0.5%. When contained, the content of Sr is to be 0.5% or less, the content of Sb is to be 0.5% or less, the content of Pb is to be 0.5% or less, and the content of B is to be 0.5% or less.

A preferable lower limit of the content of each of these elements is more than 0%, and more preferably is 0.1%.

A preferable upper limit of the content of each of these elements is less than 0.5%, and more preferably is 0.4%.

[Method for Measuring Chemical Composition of Hot Dip Galvanized Layer]

The chemical composition of the hot dip galvanized layer can be determined by the following method. The hot dip galvanized layer is dissolved using hydrochloric acid containing an inhibitor. For example, a product with the trade name "IBIT" manufactured by Asahi Chemical Co., Ltd. can be used as the inhibitor. The solution is subjected to elemental analysis in the same manner as the chemical composition analysis of the hot-rolled steel sheet described above. The chemical composition of the hot dip galvanized layer can be determined by the above method.

A hot-dip coated steel sheet that includes the hot-rolled steel sheet and the hot dip galvanized layer described above not only has high strength, high rigidity, and excellent workability, but also has excellent LME resistance.

[Method for Producing Hot-Rolled Steel Sheet]

One example of a method for producing the hot-rolled steel sheet according to the present embodiment will now be described. The method for producing a hot-rolled steel sheet described hereinafter is one example of a method for producing the hot-rolled steel sheet according to the present embodiment. Accordingly, a hot-rolled steel sheet composed as described above may also be produced by a production method other than the production method described hereunder. However, the production method described hereunder is a preferable example of a method for producing the hot-rolled steel sheet according to the present embodiment.

One example of a method for producing the hot-rolled steel sheet of the present embodiment includes the following processes.

(Step 1) Starting material preparation process (Step 2) Hot rolling process (Step 3) Cooling process (Step 4) Coiling process Note that, the production method described above is carried out using production line equipment. The production line equipment includes, in order from the upstream side toward the downstream side, a reheating furnace, a rougher, a finisher, run-out table cooling equipment, and a down coiler. A plurality of transfer rolls are arranged between each piece of equipment.

The principal production conditions in the above production process are as follows.

(Step 2) Hot rolling process

Rolling finishing temperature FT: 850 to 950° C.

(Step 3) Cooling process

Early-stage cooling rate CR1: less than 25° C./second

Switching temperature ST from early-stage cooling rate to latter-stage cooling rate: 730 to 830° C.

Latter-stage cooling rate CR2: 25° C./second or more (Step 4) Coiling process

Coiling temperature CT: 470 to 620° C.

Each process is described hereunder.

[(Step 1) Starting Material Preparation Process]

In the starting material preparation process, a starting material in which the content of each element in the chemical composition is within the range of the present embodiment is prepared. The starting material is produced, for example, by the following method. Hot-dip steel in which the content of each element in the chemical composition is within the range of the present embodiment is produced. The hot-dip steel is used to produce a starting material (a slab or an ingot) by a casting process. For example, the hot-dip steel is used to produce a slab by a well-known continuous casting process. Alternatively, the hot-dip steel is used to produce an ingot by a well-known ingot-making process.

[(Step 2) Hot Rolling Process]

The prepared starting material (slab or ingot) is subjected to hot rolling to produce a steel sheet. The hot rolling process includes a rough rolling process of subjecting the starting material to rough rolling to produce a rough bar (intermediate steel sheet), and a finish rolling process of subjecting the rough bar to finish rolling to produce a steel sheet.

In the rough rolling process, the starting material (slab or ingot) is heated in a reheating furnace. The heated starting material is subjected to rolling using a rougher to produce a rough bar. The heating temperature of the starting material in the rough rolling process is, for example, 1250 to 1300° C. The in-furnace time of the starting material in the reheating furnace is 30 minutes or more, and preferably is 60 minutes or more. The upper limit of the in-furnace time is not particularly limited, and for example is 240 minutes.

In the finish rolling process, the rough bar is subjected to further rolling (finish rolling) using a finisher to thereby produce a steel sheet. The finisher includes a plurality of stands arranged in a row. Each stand includes a pair of work rolls. The surface temperature of the steel sheet on the exit side of the stand which, among the plurality of stands of the finisher, is the last stand to perform rolling of the steel sheet is defined as the rolling finishing temperature FT (° C.). In the present embodiment, the rolling finishing temperature FT is as follows.

Rolling finishing temperature FT: 850 to 950° C.

[Rolling Finishing Temperature FT: 850 to 950° C.]

If the rolling finishing temperature FT is more than 950° C., austenite grains in the steel sheet will become excessively coarse during the finish rolling. Consequently, the grains of the bainitic ferrite of the produced hot-rolled steel sheet will be coarse. On the other hand, if the rolling finishing temperature FT is less than 850° C., an excessive load will be applied to the stand.

If the rolling finishing temperature FT is 850 to 950° C., on the precondition that the other production conditions are satisfied, the average equivalent circular diameter of bainitic ferrite in the produced hot-rolled steel sheet will be 15 μm or less.

[(Step 3) Cooling Process]

In the cooling process, the steel sheet on which the finish rolling was completed is rapidly cooled using run-out table cooling equipment. Specifically, from the viewpoint of productivity, cooling of the steel sheet after the finish rolling is, for example, started using cooling equipment within three seconds after the finish rolling is completed. At the cooling equipment, the steel sheet is cooled using a cooling medium. The cooling medium is, for example, water.

The cooling rate of the steel sheet differs between the upstream side and the downstream side of the cooling equipment. The production conditions in the cooling process using the cooling equipment are as follows.

Early-stage cooling rate CR1: less than 25° C./second

Switching temperature ST from early-stage cooling rate to latter-stage cooling rate: 730 to 830° C.

Latter-stage cooling rate CR2: 25° C./second or more

Here, a period from when cooling is started using the cooling equipment until the steel sheet temperature reaches the switching temperature ST is called "early-stage cooling period", and a period until the steel sheet temperature reaches a coiling temperature CT from the switching temperature ST is called "latter-stage cooling period".

In the cooling process of the present embodiment, in the early-stage cooling period, recrystallization of austenite in the steel sheet is promoted, and fine recrystallized austenite grains are formed. By this means, austenite non-recrystallization regions are reduced as much as possible in the steel sheet, and the microstructure of the steel sheet becomes a structure composed of fine recrystallized austenite grains. Subsequently, in the latter-stage cooling period, the fine austenite is transformed to bainitic ferrite. Hereunder, the aforementioned production conditions (early-stage cooling rate CR1, switching temperature ST, and latter-stage cooling rate CR2) are described.

[Early-Stage Cooling Rate CR1: Less than 25° C./Second]

In the cooling process, first, the steel sheet after the completion of finish rolling is cooled at an early-stage cooling rate CR1. That is, in the early-stage cooling period, the steel sheet is cooled at the early-stage cooling rate CR1. If the early-stage cooling rate CR1 is 25° C./second or more, austenite non-recrystallization regions will remain in the steel sheet at the time point at which the steel sheet temperature reaches the switching temperature ST (° C.). Austenite non-recrystallization regions will be liable to become polygonal ferrite in the latter-stage cooling period. Consequently, in the produced hot-rolled steel sheet, the area fraction of bainitic ferrite will be low. In this case, in addition, the dislocation density will also be low.

If the early-stage cooling rate CR1 is less than 25° C./second, recrystallization of austenite can be promoted. Therefore, austenite non-recrystallization regions in the steel sheet can be reduced. As a result, in the microstructure of the hot-rolled steel sheet, the area fraction of bainitic ferrite can be increased, and the dislocation density can be caused to fall within the appropriate range.

The early-stage cooling rate CR1 is determined by the following equation using the rolling finishing temperature FT (° C.), the switching temperature ST (° C.), a roll speed V (m/second) of the steel sheet on the exit side of the last stand to perform rolling of the steel sheet, and a distance L1 (m) between a thermometer that measures the rolling finishing temperature FT and a thermometer that measures the switching temperature ST.

$$CR1=(FT-ST)/(L1/V)$$

A preferable upper limit of the early-stage cooling rate CR1 is 24° C./second, and more preferably is 23° C./second.

The lower limit of the early-stage cooling rate CR1 is not particularly limited. However, if the early-stage cooling rate CR1 is too slow, production efficiency will markedly decrease. Therefore, a preferable lower limit of the early-stage cooling rate CR1 is 5° C./second.

[Switching Temperature ST: 730 to 830° C.]

At the run-out table cooling equipment, the steel sheet temperature at the time that the cooling rate is switched from the early-stage cooling rate CR1 to the latter-stage cooling rate CR2 is defined as "switching temperature ST (° C.)".

If the switching temperature ST is higher than 830° C., recrystallization of austenite will proceed and coarsening will occur. As a result, grains of bainitic ferrite in the hot-rolled steel sheet will coarsen.

On the other hand, if the switching temperature ST is lower than 730° C., recrystallization of austenite will not be completed in the early-stage cooling period, and austenite non-recrystallization regions will remain in the latter-stage cooling period. In such case, polygonal ferrite will form in the hot-rolled steel sheet during the latter-stage cooling period. As a result, the area fraction of bainitic ferrite in the hot-rolled steel sheet will be low. In this case, in addition, the dislocation density will be low.

If the switching temperature ST is 730 to 830° C., the early-stage cooling period will be appropriate. Therefore, recrystallization of austenite in the steel sheet will be sufficiently promoted, and cooling at the latter-stage cooling rate CR2 can be started after austenite non-recrystallization regions have been sufficiently reduced.

A preferable upper limit of the switching temperature ST is 820° C., and more preferably is 810° C.

A preferable lower limit of the switching temperature ST is 740° C., and more preferably is 750° C.

[Latter-Stage Cooling Rate CR2: 25° C./Second or More]

After the steel sheet temperature decreases in the early-stage cooling period and reaches the switching temperature ST, cooling at the latter-stage cooling rate CR2 (the latter-stage cooling period) is started. If the latter-stage cooling rate CR2 is less than 25° C./second, the cooling rate in the latter-stage cooling period will be too slow. In such case, polygonal ferrite will form in the hot-rolled steel sheet during the latter-stage cooling period. As a result, the area fraction of bainitic ferrite in the hot-rolled steel sheet will be low. Further, the dislocation density will be low. In addition, Ti carbides will become coarse.

If the latter-stage cooling rate CR2 is 25° C./second or more, the cooling rate in the latter-stage cooling period will be sufficiently fast. Therefore, on the precondition that the other production conditions are satisfied, the area fraction of bainitic ferrite in the hot-rolled steel sheet will be 85% or more, and the average equivalent circular diameter of the grains of the bainitic ferrite will be 15 μm or less.

The latter-stage cooling rate CR2 is determined by the following equation using the switching temperature ST (° C.), the coiling temperature CT (° C.), a roll speed V (m/second) of the steel sheet on the exit side of the last stand to perform rolling of the steel sheet, and a distance L2 (m) between a thermometer that measures the switching temperature ST and a thermometer that measures the coiling temperature CT.

$$CR2=(ST-CT)/(L2/V)$$

A preferable lower limit of the latter-stage cooling rate CR2 is 30° C./second.

The upper limit of the latter-stage cooling rate CR2 is not particularly limited. When taking into consideration the equipment capacity, a preferable upper limit of the latter-stage cooling rate CR2 is 70° C./second.

[(Step 4) Coiling Process]

In the coiling process, the steel sheet that passed through the run-out table cooling equipment is coiled into a coil shape by a down coiler. In the coiling process, Ti carbides form in the steel sheet. Here, the surface temperature of the steel sheet when coiling starts is defined as "coiling temperature CT (° C.)". The coiling temperature CT influences the average equivalent circular diameter of Ti carbides. The coiling temperature CT also influences the microstructure of the hot-rolled steel sheet (the proportions of bainitic ferrite, polygonal ferrite, and bainite). Therefore, the coiling temperature CT is adjusted so as to fall within the following range.

Coiling temperature CT: 470 to 620° C.

[Coiling Temperature CT: 470 to 620° C.]

If the coiling temperature CT is higher than 620° C., it indicates that the temperature at the end of the latter-stage cooling period in the cooling process is too high. In such case, coiling will be started before transformation from austenite to bainitic ferrite in the microstructure of the steel sheet is completed. Therefore, a part of the austenite will transform to polygonal ferrite. As a result, the area fraction of bainitic ferrite in the hot-rolled steel sheet will be low. In addition, the dislocation density will be low. If the coiling temperature CT is higher than 620° C., furthermore, Ti carbides in the hot-rolled steel sheet will coarsen.

On the other hand, if the coiling temperature CT is less than 470° C., it indicates that the temperature at the end of the latter-stage cooling period in the cooling process is too low. In such case, bainite will form in the hot-rolled steel sheet. Therefore, the area fraction of bainitic ferrite in the hot-rolled steel sheet will be low.

If the coiling temperature CT is 470 to 620° C., on the precondition that the other production conditions are satisfied, the area fraction of bainitic ferrite in the microstructure of the hot-rolled steel sheet will be 85% or more. In addition, the average equivalent circular diameter of Ti carbides will be 10 nm or less.

The hot-rolled steel sheet according to the present embodiment is produced by the production processes described above. As mentioned above, the hot-rolled steel sheet of the present embodiment may also be produced by a production method other than the production method described above. As long as the hot-rolled steel sheet of the present embodiment has a chemical composition in which the content of each element is within the range of the present embodiment, and has Characteristic 1 to Characteristic 4, the production method is not particularly limited.

[Other Processes in Method for Producing Hot-Rolled Steel Sheet]

The method for producing a hot-rolled steel sheet of the present embodiment may also include other processes apart from the processes described above. For example, a temper rolling process may be performed at a stage that is after the cooling process and is before the coiling process, or may be performed after the coiling process. In the temper rolling process, the hot-rolled steel sheet is subjected to temper rolling. The temper rolling process adjusts the shape of the hot-rolled steel sheet, adjusts the surface roughness, and adjusts the yield strength. A sheet thickness reduction ratio in the temper rolling process for effectively obtaining the above advantageous effects is, for example, 0.1% or more. A preferable upper limit of the sheet thickness reduction ratio in the temper rolling process is 3.0%. In this case, introduction of excessive strain into the hot-rolled steel sheet is suppressed, and good ductility, bendability, and flangeability can be maintained.

[Method for Producing Hot-Dip Coated Steel Sheet Including Hot-Rolled Steel Sheet of Present Embodiment]

A hot-dip coated steel sheet that includes the hot-rolled steel sheet of the present embodiment can be produced by performing the following well-known hot-dipping treatment process.

[Hot-Dipping Treatment Process]

In the hot-dipping treatment process, a hot dip galvanized layer having the chemical composition described above is formed on the surface of the hot-rolled steel sheet. Specifically, a plating bath is prepared. The composition of the plating bath is adjusted according to the composition of the hot dip galvanized layer to be formed. After the hot-rolled steel sheet has been dipped in the plating bath for a certain time period, the hot-rolled steel sheet is lifted up from the plating bath by a well-known method. For example, a sink roll is arranged in the plating bath. The travelling direction of the hot-rolled steel sheet that is dipped in the plating bath is changed to the upward direction by the sink roll.

A hot-dip zinc-based coating is adhered to the surface of the hot-rolled steel sheet that is lifted up from the plating bath. The amount of the hot-dip zinc-based coating adhering to the hot-rolled steel sheet is adjusted using a well-known gas wiping apparatus. The hot-dip zinc-based coating adhering to the hot-rolled steel sheet lifted up from the plating bath solidifies to form a hot dip galvanized layer. The hot-dip coated steel sheet is produced by the above process.

[Other Processes in Method for Producing Hot-Dip Coated Steel Sheet]

The method for producing the hot-dip coated steel sheet of the present embodiment may also include other production processes apart from the hot-dipping treatment process. For example, the method for producing the hot-dip coated steel sheet of the present embodiment may include an Ni pre-plating process before the hot-dipping treatment process. In the Ni pre-plating process, the hot-rolled steel sheet described above is subjected to Ni plating to form an Ni plating layer on the surface of the hot-rolled steel sheet. The hot-rolled steel sheet on which the Ni plating layer has been formed is subjected to the hot-dipping treatment process. In this case, the adhesion of the hot dip galvanized layer to the hot-rolled steel sheet increases.

The method for producing the hot-dip coated steel sheet of the present embodiment may also include a chemical treatment process after the hot-dipping treatment process. In the chemical treatment process, the produced hot-dip coated steel sheet is subjected to a chemical treatment to form a chemical coating on the hot dip galvanized layer. When performing a chemical treatment process, the chemical treatment method is not particularly limited, and a well-known method can be used. For example, a well-known chromium chemical coating may be formed as a chemical coating.

In the method for producing the hot-dip coated steel sheet of the present embodiment, in addition, a temper rolling process may be performed after the hot-dipping treatment process. In the temper rolling process, the produced hot-dip coated steel sheet is subjected to temper rolling. In a case where the aforementioned chemical treatment process is performed, the adhesion of the chemical coating can be increased by performing a temper rolling process before the chemical treatment process. A preferable sheet thickness reduction ratio in the temper rolling process is 0.1 to 3.0%.

The method for producing the hot-dip coated steel sheet may also include other production processes. The production method described above is one example of a production method for obtaining the hot-dip coated steel sheet of the present embodiment. Therefore, a method for producing the hot-dip coated steel sheet of the present embodiment is not limited to the production method described above.

EXAMPLES

Advantageous effects of one aspect of the hot-rolled steel sheet and the hot-dip coated steel sheet of the present embodiment will now be described more specifically by way of examples. The conditions adopted in the following examples are one example of conditions employed for confirming the workability and advantageous effects of the hot-rolled steel sheet and the hot-dip coated steel sheet of the present embodiment. Accordingly, the hot-rolled steel sheet and the hot-dip coated steel sheet of the present embodiment are not limited to this one example of the conditions.

Hot-rolled steel sheets having the chemical compositions shown in Table 1 were produced.

TABLE 1

| Test | Steel | Chemical Composition (unit is mass %; balance is Fe and impurities) | | | | | | | | | | | | |
|---|---|---|---|---|---|---|---|---|---|---|---|---|---|---|
| Number | Type | C | Si | Mn | P | S | Al | N | Ti | B | Nb | V | Cr | Mo |
| 1 | A | 0.071 | 0.36 | 1.10 | 0.020 | 0.003 | 0.035 | 0.0035 | 0.118 | 0.0014 | — | — | — | — |
| 2 | B | 0.110 | 0.28 | 0.95 | 0.018 | 0.004 | 0.040 | 0.0038 | 0.120 | 0.0020 | — | — | — | — |
| 3 | C | 0.050 | 0.33 | 1.06 | 0.015 | 0.003 | 0.033 | 0.0036 | 0.110 | 0.0024 | — | — | — | — |
| 4 | D | 0.070 | 0.55 | 1.00 | 0.018 | 0.005 | 0.028 | 0.0033 | 0.100 | 0.0018 | — | — | — | — |
| 5 | E | 0.080 | 0.02 | 1.29 | 0.018 | 0.003 | 0.035 | 0.0028 | 0.131 | 0.0015 | — | — | — | — |
| 6 | F | 0.110 | 0.10 | 0.60 | 0.018 | 0.004 | 0.035 | 0.0041 | 0.180 | 0.0013 | — | — | — | — |
| 7 | G | 0.060 | 0.35 | 0.70 | 0.016 | 0.003 | 0.022 | 0.0042 | 0.075 | 0.0045 | — | — | — | — |
| 8 | C | 0.050 | 0.33 | 1.06 | 0.015 | 0.003 | 0.033 | 0.0036 | 0.110 | 0.0024 | — | — | — | — |
| 9 | C | 0.050 | 0.33 | 1.06 | 0.015 | 0.003 | 0.033 | 0.0036 | 0.110 | 0.0024 | — | — | — | — |
| 10 | C | 0.050 | 0,33 | 1.06 | 0.015 | 0.003 | 0.033 | 0,0036 | 0.110 | 0.0024 | — | — | — | — |
| 11 | C | 0.050 | 0.33 | 1.06 | 0.015 | 0.003 | 0.033 | 0.0036 | 0.110 | 0.0024 | — | — | — | — |
| 12 | C | 0.050 | 0.33 | 1.06 | 0.015 | 0.003 | 0.033 | 0.0036 | 0.110 | 0.0024 | — | — | — | — |
| 13 | C | 0.050 | 0.33 | 1.06 | 0.015 | 0.003 | 0.033 | 0.0036 | 0.110 | 0.0024 | — | — | — | — |
| 14 | C | 0.050 | 0.33 | 1.06 | 0.015 | 0.003 | 0.033 | 0.0036 | 0.110 | 0.0024 | — | — | — | — |
| 15 | C | 0.050 | 0.33 | 1.06 | 0.015 | 0.003 | 0.033 | 0.0036 | 0.110 | 0.0024 | — | — | — | — |
| 16 | C | 0.050 | 0.33 | 1.06 | 0.015 | 0.003 | 0.033 | 0.0036 | 0.110 | 0.0024 | — | — | — | — |
| 17 | C | 0.050 | 0.33 | 1.06 | 0.015 | 0.003 | 0.033 | 0.0036 | 0.110 | 0.0024 | — | — | — | — |
| 18 | C | 0.050 | 0.33 | 1.06 | 0.015 | 0.003 | 0.033 | 0.0036 | 0.110 | 0.0024 | — | — | — | — |
| 19 | R | 0.055 | 0.25 | 0.70 | 0.018 | 0.004 | 0.040 | 0.0022 | 0.060 | 0.0022 | 0.11 | — | — | — |
| 20 | S | 0.061 | 0.21 | 0.78 | 0.022 | 0.004 | 0.038 | 0.0030 | 0.070 | 0.0025 | — | 0.09 | — | — |
| 21 | H | 0.060 | 0.35 | 1.00 | 0.013 | 0.004 | 0.033 | 0.0035 | 0.080 | 0.0021 | — | — | 0.4 | — |
| 22 | I | 0.055 | 0.20 | 0.80 | 0.011 | 0.003 | 0.028 | 0.0042 | 0.080 | 0.0019 | — | — | — | 0.3 |
| 23 | A | 0.071 | 0.36 | 1.10 | 0.020 | 0.003 | 0.035 | 0.0035 | 0.118 | 0.0014 | — | — | — | — |
| 24 | A | 0.071 | 0.36 | 1.10 | 0.020 | 0.003 | 0.035 | 0.0035 | 0.118 | 0.0014 | — | — | — | — |
| 25 | A | 0.071 | 0.36 | 1.10 | 0.020 | 0.003 | 0.035 | 0.0035 | 0.118 | 0.0014 | — | — | — | — |
| 26 | T | 0.048 | 0.18 | 1.46 | 0.021 | 0.006 | 0.048 | 0.0048 | 0.145 | 0.0015 | — | — | — | — |
| 27 | U | 0.070 | 0.35 | 1.15 | 0.018 | 0.009 | 0.044 | 0.0031 | 0.130 | 0.0020 | — | — | — | — |
| 28 | V | 0.058 | 0.53 | 1.31 | 0.018 | 0.004 | 0.038 | 0.0065 | 0.070 | 0.0033 | — | — | — | — |
| 29 | W | 0.055 | 0.41 | 0.98 | 0.015 | 0.005 | 0.067 | 0.0044 | 0.121 | 0.0030 | — | — | — | — |

TABLE 1-continued

| Test Number | Steel Type | Chemical Composition (unit is mass %; balance is Fe and impurities) C | Si | Mn | P | S | Al | N | Ti | B | Nb | V | Cr | Mo |
|---|---|---|---|---|---|---|---|---|---|---|---|---|---|---|
| 30 | L | 0.130 | 0.04 | 1.12 | 0.015 | 0.004 | 0.044 | 0.0025 | 0.075 | 0.0025 | — | — | — | — |
| 31 | M | 0.035 | 0.10 | 1.40 | 0.018 | 0.003 | 0.033 | 0.0029 | 0.110 | 0.0040 | — | — | — | — |
| 32 | N | 0.060 | 0.75 | 0.70 | 0.017 | 0.003 | 0.044 | 0.0035 | 0.120 | 0.0030 | — | — | — | — |
| 33 | O | 0.110 | 0.35 | 1.60 | 0.016 | 0.003 | 0.044 | 0.0043 | 0.073 | 0.0020 | — | — | — | — |
| 34 | K | 0.090 | 0.45 | 1.40 | 0.015 | 0.004 | 0.035 | 0.0033 | 0.050 | 0.0035 | — | — | — | — |
| 35 | P | 0.060 | 0.35 | 1.10 | 0.018 | 0.003 | 0.035 | 0.0023 | 0.210 | 0.0022 | — | — | — | — |
| 36 | J | 0.070 | 0.22 | 1.10 | 0.018 | 0.005 | 0.040 | 0.0033 | 0.110 | 0.0008 | — | — | — | — |
| 37 | X | 0.091 | 0.35 | 0.72 | 0.013 | 0.003 | 0.044 | 0.0041 | 0.075 | 0.0005 | — | 0.16 | — | — |
| 38 | Q | 0.070 | 0.22 | 1.10 | 0.018 | 0.005 | 0.040 | 0.0020 | 0.110 | 0.0060 | — | — | — | — |
| 39 | Y | 0.072 | 0.26 | 0.95 | 0.022 | 0.004 | 0.045 | 0.0033 | 0.070 | 0.0058 | 0.05 | — | — | — |
| 40 | A | 0.071 | 0.36 | 1.10 | 0.020 | 0.003 | 0.035 | 0.0035 | 0.118 | 0.0014 | — | — | — | — |
| 41 | I | 0.055 | 0.20 | 0.80 | 0.011 | 0.003 | 0.028 | 0.0042 | 0.080 | 0.0019 | — | — | — | 0.3 |
| 42 | E | 0.080 | 0.02 | 1.29 | 0.018 | 0.003 | 0.035 | 0.0028 | 0.131 | 0.0015 | — | — | — | — |
| 43 | I | 0.055 | 0.20 | 0.80 | 0.011 | 0.003 | 0.028 | 0.0042 | 0.080 | 0.0019 | — | — | — | 0.3 |
| 44 | A | 0.071 | 0.36 | 1.10 | 0.020 | 0.003 | 0.035 | 0.0035 | 0.118 | 0.0014 | — | — | — | — |
| 45 | I | 0.055 | 0.20 | 0.80 | 0.011 | 0.003 | 0.028 | 0.0042 | 0.080 | 0.0019 | — | — | — | 0.3 |
| 46 | A | 0.071 | 0.36 | 1.10 | 0.020 | 0.003 | 0.035 | 0.0035 | 0.118 | 0.0014 | — | — | — | — |
| 47 | I | 0.055 | 0.20 | 0.80 | 0.011 | 0.003 | 0.028 | 0.0042 | 0.080 | 0.0019 | — | — | — | 0.3 |
| 48 | A | 0.071 | 0.36 | 1.10 | 0.020 | 0.003 | 0.035 | 0.0035 | 0.118 | 0.0014 | — | — | — | — |
| 49 | S | 0.061 | 0.21 | 0.78 | 0.022 | 0.004 | 0.038 | 0.0030 | 0.070 | 0.0025 | — | 0.09 | — | — |
| 50 | A | 0.071 | 0.36 | 1.10 | 0.020 | 0.003 | 0.035 | 0.0035 | 0.118 | 0.0014 | — | — | — | — |
| 51 | S | 0.061 | 0.21 | 0.78 | 0.022 | 0.004 | 0.038 | 0.0030 | 0.070 | 0.0025 | — | 0.09 | — | — |
| 52 | A | 0.071 | 0.36 | 1.10 | 0.020 | 0.003 | 0.035 | 0.0035 | 0.118 | 0.0014 | — | — | — | — |
| 53 | S | 0.061 | 0.21 | 0.78 | 0.022 | 0.004 | 0.038 | 0.0030 | 0.070 | 0.0025 | — | 0.09 | — | — |
| 54 | E | 0.080 | 0.02 | 1.29 | 0.018 | 0.003 | 0.035 | 0.0028 | 0.131 | 0.0015 | — | — | — | — |

The symbol "-" in Table 1 means that the content of the corresponding element was 0% when a fraction of the measured numerical value was rounded off based on the significant figure defined in the present embodiment.

For example, the symbol "-" means that the content of Nb in Test No. 1 was 0% when rounded off to two decimal places. Further, the symbol "-" means that the content of Cr in Test No. 1 was 0% when rounded off to one decimal place.

Specifically, hot-dip steel was subjected to continuous casting to produce a slab. The slab was subjected to a hot working process (rough rolling process and finish rolling process). The slab was heated for 60 mins at a temperature of 1250 to 1300° C. After heating, the slab was subjected to rolling with a rougher to produce a rough bar. Further, the rough bar was subjected to rolling with a finisher to produce a steel sheet. The rolling finishing temperature FT (° C.) of each test number was as shown in the column "FT (° C.)" in Table 2.

TABLE 2

| Test Number | FT (° C.) | Cooling Conditions CR1 (° C./sec) | ST (° C.) | CR2 (° C./sec) | CT (° C.) |
|---|---|---|---|---|---|
| 1 | 880 | 20 | 795 | 27 | 530 |
| 2 | 875 | 21 | 770 | 35 | 485 |
| 3 | 890 | 19 | 800 | 35 | 510 |
| 4 | 883 | 22 | 770 | 33 | 505 |
| 5 | 910 | 22 | 800 | 36 | 510 |
| 6 | 870 | 21 | 775 | 30 | 535 |
| 7 | 865 | 16 | 800 | 28 | 570 |
| 8 | 910 | 23 | 820 | 28 | 605 |
| 9 | 900 | 23 | 810 | 32 | 550 |
| 10 | 905 | 21 | 780 | 30 | 540 |
| 11 | 920 | 22 | 810 | 27 | 580 |
| 12 | 885 | 18 | 800 | 35 | 530 |
| 13 | 865 | 22 | 750 | 30 | 510 |
| 14 | 880 | 21 | 770 | 35 | 500 |
| 15 | 880 | 20 | 800 | 40 | 490 |
| 16 | 890 | 18 | 820 | 45 | 485 |
| 17 | 880 | 23 | 780 | 30 | 540 |

TABLE 2-continued

| Test Number | FT (° C.) | Cooling Conditions CR1 (° C./sec) | ST (° C.) | CR2 (° C./sec) | CT (° C.) |
|---|---|---|---|---|---|
| 18 | 880 | 23 | 785 | 29 | 555 |
| 19 | 895 | 23 | 780 | 28 | 530 |
| 20 | 895 | 21 | 820 | 40 | 550 |
| 21 | 910 | 22 | 780 | 31 | 500 |
| 22 | 920 | 24 | 760 | 30 | 475 |
| 23 | 880 | 20 | 800 | 37 | 540 |
| 24 | 885 | 21 | 800 | 37 | 540 |
| 25 | 890 | 23 | 800 | 37 | 540 |
| 26 | 870 | 23 | 780 | 30 | 540 |
| 27 | 880 | 22 | 780 | 28 | 530 |
| 28 | 910 | 23 | 820 | 32 | 550 |
| 29 | 880 | 20 | 800 | 37 | 540 |
| 30 | 880 | 22 | 770 | 28 | 550 |
| 31 | 899 | 24 | 780 | 30 | 544 |
| 32 | 865 | 19 | 770 | 27 | 575 |
| 33 | 880 | 23 | 760 | 30 | 560 |
| 34 | 880 | 21 | 775 | 28 | 560 |
| 35 | 905 | 23 | 790 | 35 | 525 |
| 36 | 880 | 18 | 790 | 30 | 550 |
| 37 | 895 | 22 | 770 | 33 | 530 |
| 38 | 880 | 21 | 775 | 28 | 548 |
| 39 | 905 | 22 | 775 | 29 | 530 |
| 40 | 960 | 24 | 820 | 35 | 550 |
| 41 | 965 | 24 | 810 | 34 | 555 |
| 42 | 885 | 30 | 770 | 27 | 580 |
| 43 | 870 | 29 | 765 | 27 | 575 |
| 44 | 880 | 7 | 845 | 40 | 510 |
| 45 | 900 | 8 | 841 | 30 | 550 |
| 46 | 860 | 23 | 720 | 26 | 520 |
| 47 | 878 | 24 | 715 | 26 | 530 |
| 48 | 900 | 20 | 800 | 23 | 590 |
| 49 | 865 | 23 | 760 | 21 | 605 |
| 50 | 900 | 15 | 825 | 26 | 630 |
| 51 | 898 | 16 | 810 | 26 | 645 |
| 52 | 900 | 23 | 800 | 46 | 435 |
| 53 | 897 | 23 | 797 | 45 | 450 |
| 54 | 883 | 21 | 800 | 45 | 455 |

The steel sheet after the finish rolling was subjected to a cooling process. Specifically, for each test number, cooling using run-out table cooling equipment was started within two seconds after the end of finish rolling. The early-stage cooling rate CR1 (° C./sec), switching temperature ST (° C.), and latter-stage cooling rate CR2 (° C./sec) for each test number in the cooling process were as shown in "CR1 (° C./sec)", "ST (° C.)", and "CR2 (° C./sec)", respectively, in Table 2.

After passing through the cooling equipment, the steel sheet was coiled into a coil shape by a down coiler. The coiling temperature CT (° C.) for each test number was as shown in Table 2. The coil-shaped steel sheet after coiling was allowed to cool to normal temperature, to thereby produce the hot-rolled steel sheet of each test number shown in Table 1. The thickness of the hot-rolled steel sheet of each test number was 2.3 mm.

[Evaluation Tests]

The hot-rolled steel sheet of each test number was subjected to the following evaluation tests.

(Test 1) Test to measure area fraction of bainitic ferrite, and average equivalent circular diameter of grains of bainitic ferrite (Test 2) Test to measure average equivalent circular diameter of Ti carbides (Test 3) Dislocation density measurement test (Test 4) Mechanical properties evaluation test (Test 5) Test to evaluate LME resistance of hot-dip coated steel sheet Test 1 to Test 5 are described hereunder.

[(Test 1) Test to Measure Area Fraction of Bainitic Ferrite, and Average Equivalent Circular Diameter of Grains of Bainitic Ferrite]

The area fraction (%) of bainitic ferrite, and the average equivalent circular diameter (μm) of the grains of bainitic ferrite were determined for the hot-rolled steel sheet of each test number by the methods described in the above [Method for measuring area fraction of bainitic ferrite] and [Method for measuring equivalent circular diameter of grains of bainitic ferrite]. The obtained area fraction of bainitic ferrite is shown in the column "BF Area Fraction (%)" in Table 3. Further, the obtained average equivalent circular diameter of the grains of bainitic ferrite is shown in the column "BF Grain Diameter (μm)" in Table 3.

TABLE 3

| | Hot-rolled Steel Sheet | | | | | | | | |
|---|---|---|---|---|---|---|---|---|---|
| | Microstructure | | | | Mechanical Properties | | | | |
| Test Number | BF Area Fraction (%) | BF Grain Diameter (μm) | TIC Grain Diameter (nm) | Dislocation Density ($\times 10^{13}/m^2$) | YS (MPa) | TS (MPa) | YR (%) | T · EL (%) | Remarks |
| 1 | 95 | 8 | 7 | 15.0 | 722 | 820 | 88 | 17.3 | Inventive Example of Present Invention |
| 2 | 97 | 9 | 6 | 89.0 | 790 | 870 | 91 | 16.5 | Inventive Example of Present Invention |
| 3 | 94 | 10 | 8 | 18.0 | 710 | 799 | 89 | 16.3 | Inventive Example of Present Invention |
| 4 | 94 | 11 | 7 | 38.0 | 698 | 805 | 87 | 18.8 | Inventive Example of Present Invention |
| 5 | 93 | 11 | 7 | 40.0 | 742 | 812 | 91 | 15.9 | Inventive Example of Present Invention |
| 6 | 89 | 9 | 6 | 32.0 | 815 | 865 | 94 | 14.8 | Inventive Example of Present Invention |
| 7 | 87 | 8 | 8 | 9.8 | 710 | 800 | 89 | 16.5 | Inventive Example of Present Invention |
| 8 | 88 | 13 | 9 | 12.0 | 750 | 830 | 90 | 18.0 | Inventive Example of Present Invention |
| 9 | 92 | 10 | 7 | 21.0 | 775 | 825 | 94 | 16.0 | Inventive Example of Present Invention |
| 10 | 91 | 10 | 7 | 23.0 | 765 | 800 | 96 | 16.3 | Inventive Example of Present Invention |

TABLE 3-continued

| | Hot-rolled Steel Sheet | | | | | | | | |
|---|---|---|---|---|---|---|---|---|---|
| | Microstructure | | | | Mechanical Properties | | | | |
| Test Number | BF Area Fraction (%) | BF Grain Diameter (μm) | TIC Grain Diameter (nm) | Dislocation Density ($\times 10^{13}/m^2$) | YS (MPa) | TS (MPa) | YR (%) | T · EL (%) | Remarks |
| 11 | 88 | 11 | 8 | 15.0 | 710 | 810 | 88 | 17.3 | Inventive Example of Present Invention |
| 12 | 93 | 9 | 8 | 25.0 | 750 | 823 | 91 | 16.3 | Inventive Example of Present Invention |
| 13 | 94 | 9 | 5 | 40.0 | 733 | 813 | 90 | 16.3 | Inventive Example of Present Invention |
| 14 | 94 | 10 | 5 | 55.0 | 710 | 808 | 88 | 16.3 | Inventive Example of Present Invention |
| 15 | 96 | 8 | 5 | 75.0 | 800 | 833 | 96 | 15.2 | Inventive Example of Present Invention |
| 16 | 94 | 8 | 5 | 90.0 | 801 | 840 | 95 | 15.8 | Inventive Example of Present Invention |
| 17 | 88 | 10 | 7 | 18.0 | 710 | 799 | 89 | 16.3 | Inventive Example of Present Invention |
| 18 | 89 | 10 | 7 | 25.0 | 710 | 799 | 89 | 16.3 | Inventive Example of Present Invention |
| 19 | 93 | 7 | 8 | 75.0 | 800 | 860 | 93 | 16.0 | Inventive Example of Present Invention |
| 20 | 91 | 8 | 8 | 50.0 | 798 | 855 | 93 | 16.0 | Inventive Example of Present Invention |
| 21 | 93 | 12 | 8 | 11.0 | 735 | 810 | 91 | 16.5 | Inventive Example of Present Invention |
| 22 | 94 | 13 | 8 | 99.0 | 722 | 812 | 89 | 16.1 | Inventive Example of Present Invention |
| 23 | 93 | 8 | 7 | 16.0 | 722 | 820 | 88 | 17.3 | Inventive Example of Present Invention |
| 24 | 93 | 8 | 7 | 16.3 | 730 | 823 | 89 | 17.3 | Inventive Example of Present Invention |
| 25 | 94 | 8 | 7 | 16.4 | 745 | 819 | 91 | 16.5 | Inventive Example of Present Invention |
| 26 | 88 | 10 | 7 | 20.0 | 750 | 830 | 90 | 15.0 | Inventive Example of Present Invention |
| 27 | 91 | 7 | 8 | 50.0 | 799 | 842 | 95 | 15.6 | Inventive Example of Present Invention |

TABLE 3-continued

| | Hot-rolled Steel Sheet | | | | | | | | |
|---|---|---|---|---|---|---|---|---|---|
| | Microstructure | | | | Mechanical Properties | | | | |
| Test Number | BF Area Fraction (%) | BF Grain Diameter (μm) | TIC Grain Diameter (nm) | Dislocation Density ($\times 10^{13}/m^2$) | YS (MPa) | TS (MPa) | YR (%) | T · EL (%) | Remarks |
| 28 | 88 | 13 | 6 | 44.0 | 750 | 823 | 91 | 16.2 | Inventive Example of Present Invention |
| 29 | 87 | 8 | 8 | 11.0 | 710 | 800 | 89 | 17.0 | Inventive Example of Present Invention |
| 30 | 80 | 17 | 7 | 3.2 | 660 | 790 | 84 | 17.2 | Comparative Example |
| 31 | 97 | 10 | 8 | 230.0 | 745 | 777 | 96 | 12.8 | Comparative Example |
| 32 | 30 | 18 | 7 | 0.3 | 650 | 820 | 79 | 18.8 | Comparative Example |
| 33 | 78 | 11 | 9 | 140.0 | 820 | 850 | 96 | 13.5 | Comparative Example |
| 34 | 50 | 16 | 7 | 5.2 | 680 | 820 | 83 | 17.1 | Comparative Example |
| 35 | 93 | 9 | 9 | 200.0 | 820 | 870 | 94 | 13.1 | Comparative Example |
| 36 | 84 | 8 | 15 | 1.8 | 600 | 730 | 82 | 18.0 | Comparative Example |
| 37 | 81 | 8 | 14 | 1.5 | 630 | 766 | 82 | 17.9 | Comparative Example |
| 38 | 82 | 10 | 7 | 360.0 | 850 | 890 | 96 | 13.0 | Comparative Example |
| 39 | 81 | 10 | 7 | 390.1 | 844 | 885 | 95 | 13.0 | Comparative Example |
| 40 | 86 | 19 | 8 | 12.0 | 700 | 830 | 84 | 16.2 | Comparative Example |
| 41 | 86 | 18 | 9 | 11.0 | 660 | 795 | 83 | 16.9 | Comparative Example |
| 42 | 75 | 13 | 9 | 4.0 | 650 | 785 | 83 | 19.0 | Comparative Example |
| 43 | 80 | 13 | 9 | 5.3 | 660 | 791 | 83 | 17.1 | Comparative Example |
| 44 | 87 | 20 | 8 | 25.0 | 680 | 829 | 82 | 17.0 | Comparative Example |
| 45 | 87 | 19 | 9 | 24.3 | 665 | 799 | 83 | 16.8 | Comparative Example |
| 46 | 75 | 13 | 8 | 5.0 | 630 | 810 | 78 | 16.1 | Comparative Example |
| 47 | 77 | 14 | 8 | 5.8 | 610 | 785 | 78 | 16.2 | Comparative Example |
| 48 | 75 | 13 | 13 | 5.0 | 630 | 760 | 83 | 19.0 | Comparative Example |
| 49 | 74 | 12 | 12 | 6.1 | 625 | 775 | 81 | 19.5 | Comparative Example |
| 50 | 78 | 12 | 12 | 6.5 | 635 | 775 | 82 | 17.0 | Comparative Example |
| 51 | 77 | 11 | 13 | 5.3 | 640 | 769 | 83 | 17.5 | Comparative Example |
| 52 | 55 | 10 | 8 | 320.5 | 830 | 860 | 97 | 12.1 | Comparative Example |
| 53 | 61 | 11 | 8 | 280.0 | 832 | 871 | 96 | 12.9 | Comparative Example |
| 54 | 58 | 9 | 7 | 430.3 | 830 | 880 | 94 | 12.0 | Comparative Example |

[(Test 2) Test to Measure Average Equivalent Circular Diameter of Ti Carbides]

The average equivalent circular diameter of Ti carbides of the hot-rolled steel sheet of each test number was determined by the method described in the above [Method for measuring average equivalent circular diameter of Ti carbides]. The obtained average equivalent circular diameter of Ti carbides is shown in the column "TiC Grain Diameter (nm)" in Table 3.

[(Test 3) Dislocation Density Measurement Test]

The dislocation density of the hot-rolled steel sheet of each test number was determined by the method described in the above [Method for measuring dislocation density]. The obtained dislocation density is shown in the column "Dislocation Density ($\times 10^{13}/m^2$)" in Table 3.

[(Test 4) Mechanical Properties Evaluation Test]

The tensile strength TS, yield ratio YR, and total elongation T.EL of the hot-rolled steel sheet of each test number was determined by a tensile test in accordance with JIS Z 2241: 2011.

Specifically, a sheet-shaped tensile test specimen corresponding to a JIS No. 5 test coupon specified in JIS Z 2241: 2011 was taken from a central position of the width of the hot-rolled steel sheet of each test number. The longitudinal direction of the test specimen was made a direction orthogonal to the rolling direction of the hot-rolled steel sheet. In accordance with JIS Z 2241: 2011, a tensile test was conducted at normal temperature in air, and the yield strength YS, the tensile strength TS, and the total elongation T.EL were determined. The 0.2% proof stress was defined as the yield strength YS (MPa). The yield ratio YR was determined by the following equation using the obtained yield strength YS (MPa) and tensile strength TS (MPa).

$$\text{Yield ratio } YR = YS/TS$$

The obtained yield strength YS (MPa), tensile strength TS (MPa), yield ratio YR (%), and total elongation T.EL (%) are shown in the columns "YS (MPa)", "TS (MPa)", "YR (%)", and "T.EL (%)" in Table 3.

[(Test 5) Test to Evaluate LME Resistance of Hot-Dip Coated Steel Sheet]

[Production of Hot-Dip Coated Steel Sheet]

In order to evaluate the LME resistance of the hot-dip coated steel sheets, first, hot-dip coated steel sheets were produced using the hot-rolled steel sheet of each test number. Specifically, the hot-rolled steel sheet of each test number was subjected to a well-known hot-dipping treatment to form a hot dip galvanized layer having a chemical composition shown in Table 4 on the surface of each hot-rolled steel sheet. The plating number of the hot dip galvanized layer formed on the hot-rolled steel sheet of each test number is shown in the column "Plating Number" of the column "Plated Steel Sheet" in Table 5. The plating numbers shown in the column "Plating Number" of the column "Plated Steel Sheet" in Table 5 correspond to the plating numbers in Table 4. Hot-dip coated steel sheets were produced by the above production process.

TABLE 4

| Plating Number | Plating Composition (unit is mass %; balance is Fe and impurities) | | | | | | | | |
|---|---|---|---|---|---|---|---|---|---|
| | Zn | Al | Mg | Sn Group (Sn, Bi, In) | Ca Group (Ca, Y, La, Ce) | Si | Cr Group (Cr, Ti, Ni, Co, V, Nb, Cu, Mn) | Fe | Sr Group (Sr, Sb, Pb, B) |
| P1 | 73.70 | 19.50 | 6.8 | — | — | — | — | — | — |
| P2 | 74.39 | 19.50 | 6.0 | Sn: 0.30 | — | — | — | — | — |
| P3 | 74.91 | 19.20 | 5.8 | Bi: 0.21 | — | — | — | — | — |
| P4 | 78.92 | 16.70 | 4.3 | In: 0.23 | — | — | — | — | — |
| P5 | 74.58 | 18.90 | 6.4 | — | Ca: 0.31 | — | — | — | — |
| P6 | 76.78 | 17.70 | 5.4 | — | Y: 0.12 | — | — | — | — |
| P7 | 74.95 | 20.50 | 4.5 | — | La: 0.05 | — | — | — | — |
| P8 | 77.93 | 17.20 | 4.8 | — | Ce: 0.07 | — | — | — | — |
| P9 | 75.55 | 18.50 | 5.7 | — | — | 0.25 | — | — | — |
| P10 | 73.70 | 19.80 | 6.4 | — | — | — | Ni: 0.1 | — | — |
| P11 | 76.20 | 18.10 | 5.2 | — | — | — | — | 0.5 | — |
| P12 | 75.00 | 18.80 | 6.1 | — | — | — | — | — | Sr: 0.1 |
| P13 | 84.27 | 12.00 | 3.5 | — | — | 0.23 | — | — | — |
| P14 | 90.75 | 6.50 | 2.7 | — | — | 0.05 | — | — | — |
| P15 | 99.89 | 0.11 | 1 | — | — | — | — | — | — |
| P16 | 65.05 | 24.90 | 10.0 | — | — | 0.05 | — | — | — |
| P17 | 83.00 | 12.00 | 5.0 | — | — | — | — | — | — |
| P18 | 82.95 | 12.00 | 5.0 | — | — | 0.05 | — | — | — |

TABLE 5

| Test Number | Plated Steel Sheet Plating Number | LME Resistance Evaluation | Remarks |
|---|---|---|---|
| 1 | P1 | E | Inventive Example of Present Invention |
| 2 | P1 | E | Inventive Example of Present Invention |
| 3 | P1 | E | Inventive Example of Present Invention |
| 4 | P1 | E | Inventive Example of Present Invention |
| 5 | P1 | E | Inventive Example of Present Invention |
| 6 | P1 | E | Inventive Example of Present Invention |
| 7 | P1 | E | Inventive Example of Present Invention |
| 8 | P2 | E | Inventive Example of Present Invention |

TABLE 5-continued

| Test Number | Plated Steel Sheet Plating Number | LME Resistance Evaluation | Remarks |
|---|---|---|---|
| 9 | P3 | E | Inventive Example of Present Invention |
| 10 | P4 | E | Inventive Example of Present Invention |
| 11 | P5 | E | Inventive Example of Present Invention |
| 12 | P6 | E | Inventive Example of Present Invention |
| 13 | P7 | E | Inventive Example of Present Invention |
| 14 | P8 | E | Inventive Example of Present Invention |
| 15 | P9 | E | Inventive Example of Present Invention |
| 16 | P10 | E | Inventive Example of Present Invention |
| 17 | P11 | E | Inventive Example of Present Invention |
| 18 | P12 | E | Inventive Example of Present Invention |
| 19 | P1 | E | Inventive Example of Present Invention |
| 20 | P1 | E | Inventive Example of Present Invention |
| 21 | P1 | E | Inventive Example of Present Invention |
| 22 | P1 | E | Inventive Example of Present Invention |
| 23 | P13 | E | Inventive Example of Present Invention |
| 24 | P14 | E | Inventive Example of Present Invention |
| 25 | P15 | E | Inventive Example of Present Invention |
| 26 | P16 | E | Inventive Example of Present Invention |
| 27 | P17 | E | Inventive Example of Present Invention |
| 28 | P18 | E | Inventive Example of Present Invention |
| 29 | P3 | E | Inventive Example of Present Invention |
| 30 | P1 | E | Comparative Example |
| 31 | P1 | E | Comparative Example |
| 32 | P1 | E | Comparative Example |
| 33 | P1 | E | Comparative Example |
| 34 | P1 | E | Comparative Example |
| 35 | P1 | E | Comparative Example |
| 36 | P1 | B | Comparative Example |
| 37 | P1 | B | Comparative Example |
| 38 | P1 | B | Comparative Example |
| 39 | P1 | B | Comparative Example |
| 40 | P1 | E | Comparative Example |
| 41 | P1 | E | Comparative Example |
| 42 | P1 | E | Comparative Example |
| 43 | P1 | E | Comparative Example |
| 44 | P1 | E | Comparative Example |
| 45 | P1 | E | Comparative Example |
| 46 | P1 | E | Comparative Example |
| 47 | P1 | E | Comparative Example |
| 48 | P1 | E | Comparative Example |
| 49 | P2 | E | Comparative Example |
| 50 | P1 | E | Comparative Example |
| 51 | P2 | E | Comparative Example |
| 52 | P1 | E | Comparative Example |
| 53 | P2 | E | Comparative Example |
| 54 | P1 | E | Comparative Example |

Note that, the symbol of an element written on the left side of a numerical value in Table 4 means the contained element. For example, for plating number P2, it means that, as an element of the Sn group, Sn is contained in an amount of 0.30% by mass.

The LME resistance of the produced hot-dip coated steel sheet of each test number was evaluated by the following method.

A sample steel sheet having dimensions of 100 mm×75 mm×the same thickness as the sheet thickness was taken from the hot-dip coated steel sheet of each test number. Arc welding illustrated in FIG. 1 was performed using the sample steel sheet. Specifically, a cylindrical boss member 1 having a diameter of 20 mm and a length of 25 mm was prepared. The boss member 1 was made of a steel material equivalent to SS400 defined in JIS G3101: 2015.

As illustrated in FIG. 1, the boss member 1 was arranged at the center position of the sample steel sheet 2 in a manner so that the axial direction of the boss member 1 was the normal direction of the surface of the sample steel sheet 2. The arranged boss member 1 was welded to the sample steel sheet 2 by arc welding. The welding wire used was YGW-12 wire defined in JIS Z 3312: 2009. In the arc welding, a weld bead 3 was run around the entire circumference of the boss member 1 one time in the clockwise direction from the welding starting point in plan view, and after passing the welding starting point, the arc welding was further continued so as to continue the welding until an overlapping region 4 of the weld bead was formed. The width of the overlapping region 4 was approximately 15 mm.

The current value during the arc welding was set to 190 A, and the voltage value was set to 23 V. The welding speed was set to 0.3 m/minute. A gaseous mixture composed of 20% by volume of $CO_2$ gas and 80% by volume of argon gas was used as a shielding gas during the arc welding. The shielding gas flow rate during the arc welding was set to 20 l/minute.

Figure 2:
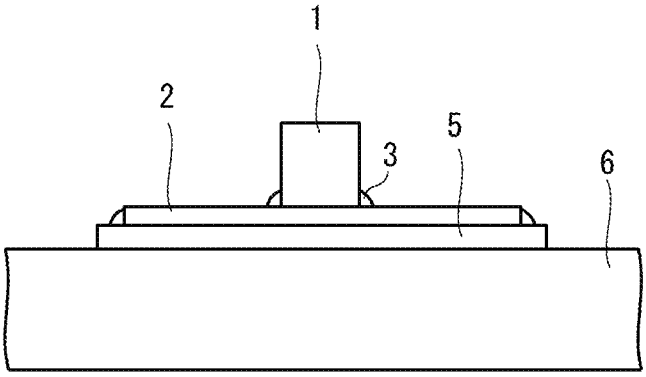
FIG. 2 is a cross-sectional view of the LME resistance evaluation test of FIG. 1 as viewed from the side.

Before performing the arc welding illustrated in FIG. 1, the sample steel sheet 2 was joined in advance to a restraint plate 5 as illustrated in FIG. 2. A steel sheet equivalent to SS400 defined in JIS G3101: 2015 having dimensions of 120 mm×95 mm×4 mm in thickness was used as the restraint plate 5. The sample steel sheet 2 was placed on the surface of the restraint plate 5. The entire circumference of the placed sample steel sheet 2 was welded to the restraint plate 5. The welding wire and welding conditions were the same as those used when welding the boss member 1 to the sample steel sheet 2.

Before performing the welding of the boss member 1 illustrated in FIG. 1, as illustrated in FIG. 2, the sample steel sheet 2 peripherally welded to the restraint plate 5 was placed on a base 6, and the sample steel sheet 2 and the restraint plate 5 were fixed to the base 6 by an unshown clamp. After the sample steel sheet 2 had been fixed to the base 6 by the clamp, the boss member 1 was welded to the sample steel sheet 2 by arc welding as illustrated in FIG. 1.

After the boss member 1 was arc-welded to the sample steel sheet 2, as illustrated in FIG. 1, the boss member 1, the sample steel sheet 2, and the restraint plate 5 were cut along a cutting plane 7 that passed through the central axis of the boss member 1 and passed through the overlapping region 4 of the weld bead 3. The cutting plane 7 was then observed at a magnification of ×100 using an optical microscope. In the observation, whether or not cracks (liquid metal embrittlement) were present in the sample steel sheet was confirmed by visual observation. If cracks were observed, the crack lengths were measured. The largest crack length among the measured crack lengths was identified. If the largest crack length was 1.0 mm or less, it was determined that the sample steel sheet was excellent in LME resistance (indicated by "E" (Excellent) in the column "LME Resistance Evaluation" in Table 5). On the other hand, if the largest crack length was more than 1.0 mm, it was determined that the LME resistance was low (indicated by "B" (Bad) in the column "LME Resistance Evaluation" in Table 5).

[Evaluation Results]

Referring to Table 1 to Table 5, the content of each element in the chemical composition of each of the hot-rolled steel sheets of Test Nos. 1 to 29 was appropriate. Further, in the hot-rolled steel sheets of Test Nos. 1 to 29, the area fraction of bainitic ferrite was 85% or more, and the average equivalent circular diameter of the grains of bainitic ferrite was 15 μm or less. In addition, in the hot-rolled steel sheets of Test Nos. 1 to 29, the average equivalent circular diameter of Ti carbides was 10 nm or less, and the dislocation density was 8.0 to $100.0\times10^{13}/m^2$. Therefore, in each of the hot-rolled steel sheets of Test Nos. 1 to 29, the tensile strength TS was 780 MPa or more. Further, the yield ratio YR was 85% or more, and thus excellent rigidity was exhibited. In addition, the total elongation T.EL was 14.0% or more, and thus excellent workability (ductility) was exhibited.

On the other hand, in Test No. 30, the content of C was too high. Therefore, polygonal ferrite formed in the microstructure of the hot-rolled steel sheet, and the area fraction of bainitic ferrite was less than 85%. Further, the average equivalent circular diameter of the bainitic ferrite was more than 15 μm. In addition, the dislocation density of the hot-rolled steel sheet was less than $8.0\times10^{13}/m^2$. Therefore, the yield ratio YR was less than 85%, and sufficient rigidity was not obtained.

In Test No. 31, the content of C was too low. Consequently, the dislocation density of the hot-rolled steel sheet was more than $100.0\times10^{13}/m^2$. Therefore, the total elongation T.EL was less than 14.0%, and sufficient workability was not obtained. In addition, the tensile strength TS of the hot-rolled steel sheet was less than 780 MPa, and sufficient strength was not obtained.

In Test No. 32, the content of Si was too high. Therefore, polygonal ferrite formed in the microstructure of the hot-rolled steel sheet, and the area fraction of bainitic ferrite was less than 85%. Further, the average equivalent circular diameter of the bainitic ferrite was more than 15 μm. In addition, the dislocation density of the hot-rolled steel sheet was less than $8.0\times10^{13}/m^2$. Therefore, the yield ratio YR was less than 85%, and sufficient rigidity was not obtained.

In Test No. 33 the content of Mn was too high. Therefore, bainite formed in the microstructure of the hot-rolled steel sheet, and the area fraction of bainitic ferrite was less than 85%. In addition, the dislocation density of the hot-rolled steel sheet was more than $100.0\times10^{13}/m^2$. Therefore, the total elongation T.EL was less than 14.0%, and sufficient workability was not obtained.

In Test No. 34, the content of Ti was too low. Therefore, polygonal ferrite formed in the microstructure of the hot-rolled steel sheet, and the area fraction of bainitic ferrite was less than 85%. Further, the average equivalent circular diameter of the bainitic ferrite was more than 15 μm. In addition, the dislocation density of the hot-rolled steel sheet was less than $8.0\times10^{13}/m^2$. Therefore, YR was less than 85%, and sufficient rigidity was not obtained.

In Test No. 35, the content of Ti was too high. Therefore, the dislocation density of the hot-rolled steel sheet was more than $100.0\times10^{13}/m^2$. Consequently, the total elongation T.EL was less than 14.0%, and sufficient workability was not obtained.

In each of Test Nos. 36 and 37, the content of B was too low. Therefore, in the microstructure of the hot-rolled steel sheet, the area fraction of bainitic ferrite was less than 85%. Further, the average equivalent circular diameter of Ti carbides in the hot-rolled steel sheet was more than 10 nm. In addition, the dislocation density was less than $8.0\times10^{13}/m^2$. Therefore, the tensile strength TS was less than 780 MPa, and sufficient strength was not obtained. Further, the yield ratio YR was less than 85%, and sufficient rigidity was not obtained. In addition, sufficient LME resistance was not obtained.

In each of Test Nos. 38 and 39, the content of B was too high. Therefore, the dislocation density of the hot-rolled steel sheet was more than $100.0\times10^{13}/m^2$. Consequently, the total elongation T.EL was less than 14.0%, and sufficient workability was not obtained. In addition, sufficient LME resistance was not obtained.

In each of Test Nos. 40 and 41, the content of each element in the chemical composition of the hot-rolled steel sheet was appropriate. However, the rolling finishing temperature FT in the production process was too high. Therefore, the average equivalent circular diameter of the grains of bainitic ferrite in the hot-rolled steel sheet was more than 15 μm. As a result, the yield ratio YR was less than 85%, and sufficient rigidity was not obtained.

In each of Test Nos. 42 and 43, the content of each element in the chemical composition of the hot-rolled steel sheet was appropriate. However, the early-stage cooling rate CR1 in the cooling process of the production process was too fast. Therefore, polygonal ferrite formed in the microstructure of the hot-rolled steel sheet, and the area fraction of bainitic ferrite was less than 85%. In addition, the dislocation density of the hot-rolled steel sheet was less than $8.0\times10^{13}/m^2$. As a result, the yield ratio YR was less than 85%, and sufficient rigidity was not obtained.

In each of Test Nos. 44 and 45, the content of each element in the chemical composition of the hot-rolled steel sheet was appropriate. However, the switching temperature ST in the cooling process of the production process was too high. Therefore, austenite grains became coarse, and the average equivalent circular diameter of the bainitic ferrite in the hot-rolled steel sheet was more than 15 μm. As a result, the yield ratio YR was less than 85%, and sufficient rigidity was not obtained.

In each of Test Nos. 46 and 47, the content of each element in the chemical composition of the hot-rolled steel sheet was appropriate. However, the switching temperature ST in the cooling process of the production process was too low. Therefore, polygonal ferrite formed in the microstructure of the hot-rolled steel sheet, and the area fraction of bainitic ferrite was less than 85%. In addition, the dislocation density of the hot-rolled steel sheet was less than $8.0\times10^{13}/m^2$. As a result, the yield ratio YR was less than 85%, and sufficient rigidity was not obtained.

In each of Test Nos. 48 and 49, the content of each element in the chemical composition of the hot-rolled steel sheet was appropriate. However, the latter-stage cooling rate CR2 in the cooling process of the production process was too slow. Therefore, polygonal ferrite formed in the microstructure of the hot-rolled steel sheet, and the area fraction of bainitic ferrite was less than 85%. Further, the dislocation density of the hot-rolled steel sheet was less than $8.0\times10^{13}/m^2$. In addition, the average equivalent circular diameter of Ti carbides was more than 10 nm. Therefore, the tensile strength TS was less than 780 MPa, and sufficient strength was not obtained. In addition, the yield ratio YR was less than 85%, and sufficient rigidity was not obtained.

In each of Test Nos. 50 and 51, the content of each element in the chemical composition of the hot-rolled steel sheet was appropriate. However, the coiling temperature CT in the coiling process was too high. Therefore, polygonal ferrite formed in the microstructure of the hot-rolled steel sheet, and the area fraction of bainitic ferrite was less than 85%. Further, the average equivalent circular diameter of Ti carbides was more than 10 nm. In addition, the dislocation density of the hot-rolled steel sheet was less than $8.0\times10^{13}/m^2$. Therefore, the tensile strength TS was less than 780 MPa, and sufficient strength was not obtained. In addition, the yield ratio YR was less than 85%, and sufficient rigidity was not obtained.

In each of Test Nos. 52 to 54, the content of each element in the chemical composition of the hot-rolled steel sheet was appropriate. However, the coiling temperature CT in the coiling process was too low. Consequently, bainite formed in the microstructure of the hot-rolled steel sheet. Therefore, the area fraction of bainitic ferrite was less than 85%, and the dislocation density of the hot-rolled steel sheet was more than $100.0\times10^{13}/m^2$. Therefore, the total elongation T.EL was less than 14.0%, and sufficient workability was not obtained.

An embodiment of the present disclosure has been described above. However, the embodiment described above is merely an example for carrying out the present disclosure. Therefore, the present disclosure is not limited to the above-described embodiment, and can be implemented by appropriately modifying the above embodiment within a range that does not depart from the gist of the present disclosure.

The invention claimed is:

1. A hot-rolled steel sheet consisting of, in mass %,
C: 0.040 to 0.120%,
Si: 0.01 to 0.60%,
Mn: 0.50 to 1.50%,
P: 0.025% or less,
S: 0.010% or less,
Al: 0.010 to 0.070%,
N: 0.0070% or less,
Ti: 0.055 to 0.200%,
B: 0.0010 to 0.0050%,
Nb: 0 to 0.20%,
V: 0 to 0.20%,
Cr: 0 to 1.0%, and
Mo: 0 to 1.0%,
with the balance being Fe and impurities,
wherein:
in the microstructure, an area fraction of bainitic ferrite is 85% or more,
a dislocation density is $8.0\times10^{13}$ to $100.0\times10^{13}/m^2$,
an average equivalent circular diameter of Ti carbides in the hot-rolled steel sheet is 10 nm or less, and
an average equivalent circular diameter of grains of the bainitic ferrite is 15 μm or less.

2. The hot-rolled steel sheet according to claim 1, containing, in mass %, one or more kinds of element selected from a group consisting of:
Nb: 0.01 to 0.20%,
V: 0.01 to 0.20%,
Cr: 0.1 to 1.0%, and
Mo: 0.1 to 1.0%.

3. A hot-dip coated steel sheet, comprising:
the hot-rolled steel sheet according to claim 1, and
a hot-dip galvanized layer which is formed on a surface of the hot-rolled steel sheet and which contains Zn in an amount of 65.00% or more by mass.

4. A method for producing the hot-rolled steel sheet according to claim 1, comprising:
a rough rolling process of subjecting a starting material to rough rolling using a rougher to produce a rough bar,
a finish rolling process of subjecting the rough bar to finish rolling using a finisher to produce a steel sheet, in which a rolling finishing temperature FT is set in a range of 850 to 950° C.,
a cooling process of cooling the steel sheet after the finish rolling is completed, and
a coiling process of coiling the steel sheet after the cooling process, at a coiling temperature of 470 to 620° C.,
wherein, in the cooling process:
cooling of the steel sheet using cooling equipment is started within three seconds after the finish rolling is completed,
and when a period from when cooling using the cooling equipment is started until the temperature of the steel sheet reaches a switching temperature ST is defined as an early-stage cooling period, and a period until the temperature of the steel sheet reaches the coiling temperature from the switching temperature ST is defined as a latter-stage cooling period,
an early-stage cooling rate CR1 that is a cooling rate in the early-stage cooling period is set to less than 25° C./second,
the switching temperature ST is set to 730 to 830° C., and
a latter-stage cooling rate CR2 that is a cooling rate in the latter-stage cooling period is set to 25° C./second or more.

* * * * *